US007197923B1

(12) United States Patent
Wright et al.

(10) Patent No.: US 7,197,923 B1
(45) Date of Patent: Apr. 3, 2007

(54) SINGLE PHASE FLUID SAMPLER SYSTEMS AND ASSOCIATED METHODS

(75) Inventors: Adam D. Wright, Dallas, TX (US); David Larimore, Dallas, TX (US); Roger L. Schultz, Aubrey, TX (US); Timothy R. Carlson, Dallas, TX (US); Cyrus Irani, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/268,311

(22) Filed: Nov. 7, 2005

(51) Int. Cl.
*E21B 49/00* (2006.01)

(52) U.S. Cl. ..... 73/152.23

(58) Field of Classification Search ..... 73/152.23, 73/152.27, 152.28, 863.83, 863.84, 863.86, 73/864.73, 864.62, 864.63, 864.67, 864.31; 166/264

See application file for complete search history.

(56) References Cited

U.S. PATENT DOCUMENTS

| | | | | |
|---|---|---|---|---|
| 4,665,983 | A | 5/1987 | Ringgenberg | |
| 4,787,447 | A | 11/1988 | Christensen | |
| 4,903,765 | A | 2/1990 | Zunkel | |
| 5,058,674 | A | 10/1991 | Schultz et al. | |
| 5,240,072 | A | 8/1993 | Schultz et al. | |
| 5,329,811 | A | 7/1994 | Schultz et al. | |
| 6,065,355 | A | 5/2000 | Schultz | |
| 6,073,698 | A | 6/2000 | Schultz et al. | |
| 6,182,753 | B1 | 2/2001 | Schultz | |
| 6,182,757 | B1 | 2/2001 | Schultz | |
| 6,189,392 | B1 | 2/2001 | Schultz | |
| 6,192,984 | B1 | 2/2001 | Schultz | |
| 2003/0066646 | A1* | 4/2003 | Shammai et al. | 166/264 |
| 2004/0089448 | A1* | 5/2004 | DiFoggio | 166/264 |
| 2004/0216874 | A1* | 11/2004 | Grant et al. | 166/264 |
| 2006/0000606 | A1* | 1/2006 | Fields et al. | 166/264 |
| 2006/0101905 | A1* | 5/2006 | Bittleston et al. | 73/152.24 |

OTHER PUBLICATIONS

Competitor Product Update, Schlumberger DST Sampling Systems—SCAR, undated.
Schlumberger, "PVT Express, Accurate, mobile fluid analysis service", Oct. 2005.
Schlumberger, "MDT Single-phase sampling", 2006.
OTC 18201, "Advances in Fluid Sampling with Formation Testers for Offshore Exploration", 2006.
Schlumberger MDT drawing, "Single Phase Multisample Chamber", undated.

* cited by examiner

*Primary Examiner*—Robert Raevis
(74) *Attorney, Agent, or Firm*—Marlin R. Smith

(57) ABSTRACT

A single phase fluid sampler system and associated methods. A fluid sampling method includes the steps of: receiving a fluid sample into a sample chamber of a fluid sampler; pressurizing the fluid sample using a pressure source; and increasing pressure in the pressure source while the pressure source is in the well, thereby applying increased pressure to the fluid sample in the sample chamber. Another method includes the step of applying pressure to the well to thereby increase pressure in the pressure source, and to thereby increase pressure on the fluid sample. A fluid sampler system includes a fluid sampler with a sample chamber, a pressure source for pressurizing the sample chamber, and a device which operates to increase pressure in the pressure source while the fluid sampler is in the well.

34 Claims, 15 Drawing Sheets

SINGLE PHASE FLUID SAMPLER SYSTEMS AND ASSOCIATED METHODS

BACKGROUND

The present invention relates generally to equipment utilized and operations performed in conjunction with a subterranean well and, in an embodiment described herein, more particularly provides single phase fluid sampler systems and methods.

The benefits of retrieving a formation fluid sample without permitting the fluid sample to reach its bubble point are well known. One technique typically used to retrieve a single phase fluid sample is to transport a highly pressurized nitrogen chamber downhole, flow the fluid sample into a sample chamber, and then apply pressure from the nitrogen chamber to the fluid sample. Unfortunately, this requires that the highly pressurized nitrogen chamber be handled at the surface.

Another problem with this technique is that, if multiple fluid samples are to be taken, then multiple nitrogen chambers need to be provided, pressurized and maintained. This substantially increases the cost, preparation time and safety hazards associated with the sampling operation.

Thus, it may be seen that improvements are needed in the art of fluid sampling. The invention described below provides such improvements.

SUMMARY

In carrying out the principles of the present invention, several fluid sampler systems and associated methods are provided which solve at least one problem in the art. Examples are described below in which a fluid sampler has a annular shaped sample chamber. Another example is described below in which multiple sample chambers are used in a fluid sampler.

In one aspect of the invention, a fluid sampling method for taking at least one fluid sample is provided. The method includes the steps of: receiving the fluid sample into a sample chamber of a fluid sampler; pressurizing the fluid sample in the sample chamber using a pressure source of the fluid sampler; and increasing pressure in the pressure source while the pressure source is in the well, thereby applying increased pressure to the fluid sample in the sample chamber.

In another aspect of the invention, a fluid sampler system for use in taking at least one fluid sample is provided. The system includes a fluid sampler with a sample chamber, a pressure source for pressurizing the sample chamber, and a device which operates to increase pressure in the pressure source while the fluid sampler is in the well.

In yet another aspect of the invention, a method of taking a fluid sample in a well includes the steps of: positioning a fluid sampler in the well; receiving the fluid sample into a sample chamber of the fluid sampler; then pressurizing the fluid sample using a pressure source of the fluid sampler; and then applying pressure to the well to thereby increase pressure in the pressure source, and to thereby increase pressure on the fluid sample.

In a further aspect of the invention, a fluid sampler system includes a fluid sampler for taking one or more fluid samples in a well. The fluid sampler includes at least one sample chamber and a pressure source having a compressed gas chamber for pressurizing the sample chamber after the fluid sample is received in the sample chamber. The fluid sampler also includes a device which operates to increase pressure in the compressed gas chamber while the fluid sampler is in the well. In addition, the compressed gas chamber can also be used to pressurize multiple sample chambers.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
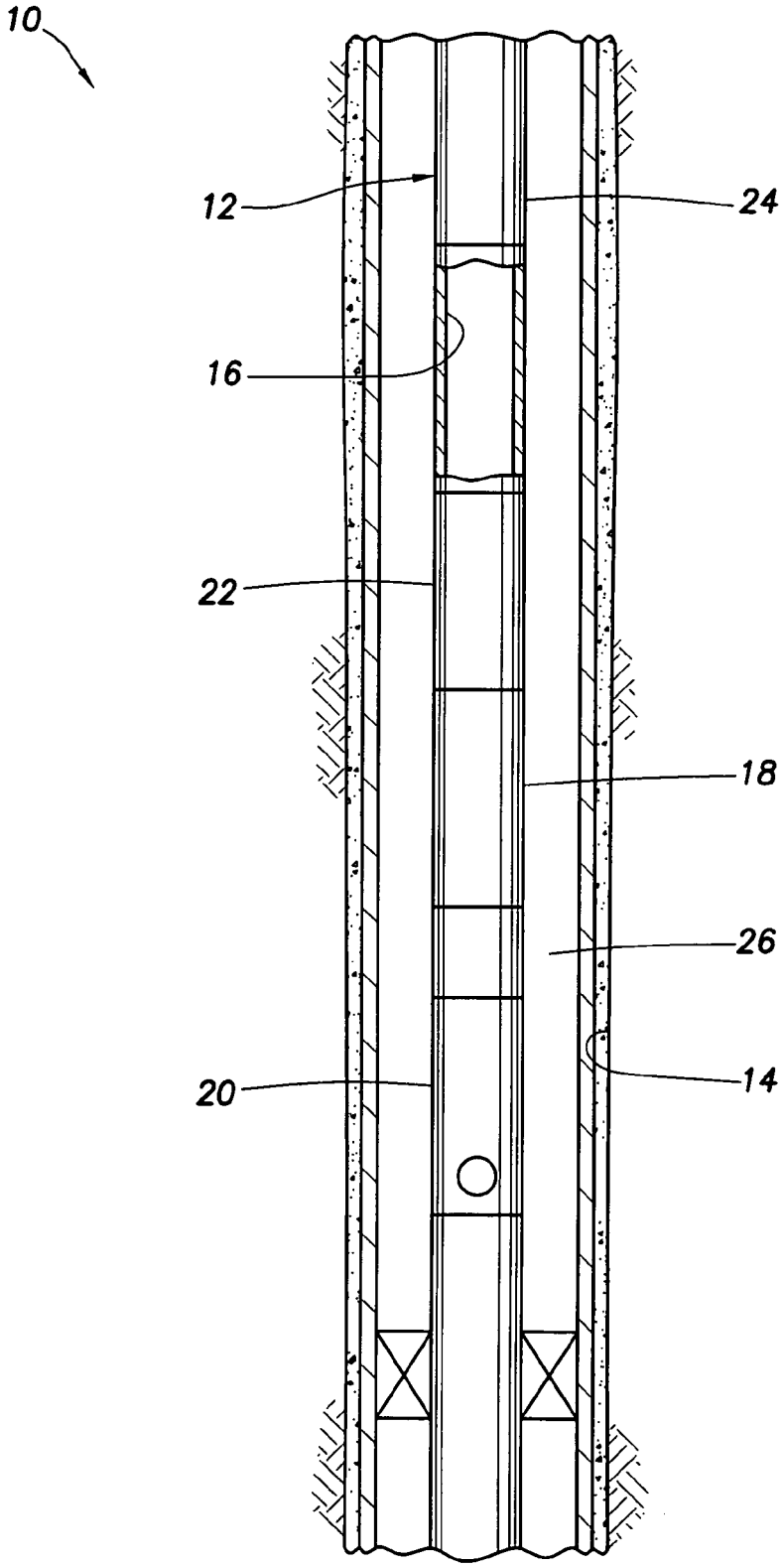
FIG. 1 is a schematic partially cross-sectional view of a fluid sampler system embodying principles of the present invention.

Representatively illustrated in FIG. 1 is a fluid sampler system 10 and associated methods which embody principles of the present invention. As depicted in FIG. 1, a tubular string 12 (such as a drill stem test string) is positioned in a wellbore 14 of a well. An internal flow passage 16 extends longitudinally through the tubular string 12.

A fluid sampler 18 is interconnected in the tubular string 12. Also preferably included in the tubular string 12 are a circulating valve 20, a tester valve 22 and a choke 24. The circulating valve 20, tester valve 22 and choke 24 may be of conventional design. However, the fluid sampler 18 includes unique features which substantially improve the art of fluid sampling.

Note that it is not necessary for the tubular string 12 to include the specific combination or arrangement of equipment described herein. It is also not necessary for the sampler 18 to be included in the tubular string 12 since, for example, the sampler 18 could instead be conveyed through the flow passage 16 (such as by using a wireline, slickline or coiled tubing) or otherwise positioned in the well. Although the wellbore 14 is depicted as being cased, it could alternatively be uncased or open hole.

In a formation testing operation, the tester valve 22 is used to selectively permit and prevent flow through the passage 16. The circulating valve 20 is used to selectively permit and prevent flow between the passage 16 and an annulus 26 formed radially between the tubular string 12 and the wellbore 14. The choke 24 is used to selectively restrict flow through the tubular string 12. Each of the valves 20, 22 and the choke 24 may be operated by manipulating pressure in the annulus 26 from the surface, or any of them could be operated by other methods if desired.

The choke 24 may be actuated to restrict flow through the passage 16 to minimize wellbore storage effects due to the large volume in the tubular string 12 above the sampler 18. When the choke 24 restricts flow through the passage 16, a pressure differential is created in the passage, thereby maintaining pressure in the passage at the sampler 18 and reducing the "drawdown" effect of opening the tester valve 22. In this manner, by restricting flow through the choke 24 at the time a fluid sample is taken in the sampler 18, the fluid sample may be prevented from going below its bubble point (the pressure below which a gas phase begins to form in a fluid phase).

The circulating valve 20 permits hydrocarbons in the tubular string 12 to be circulated out prior to retrieving the tubular string. As described more fully below, the circulating valve 20 also allows increased weight fluid to be circulated into the wellbore 14 to aid in pressurizing the fluid sample received into the sampler 18.

Figure 2:
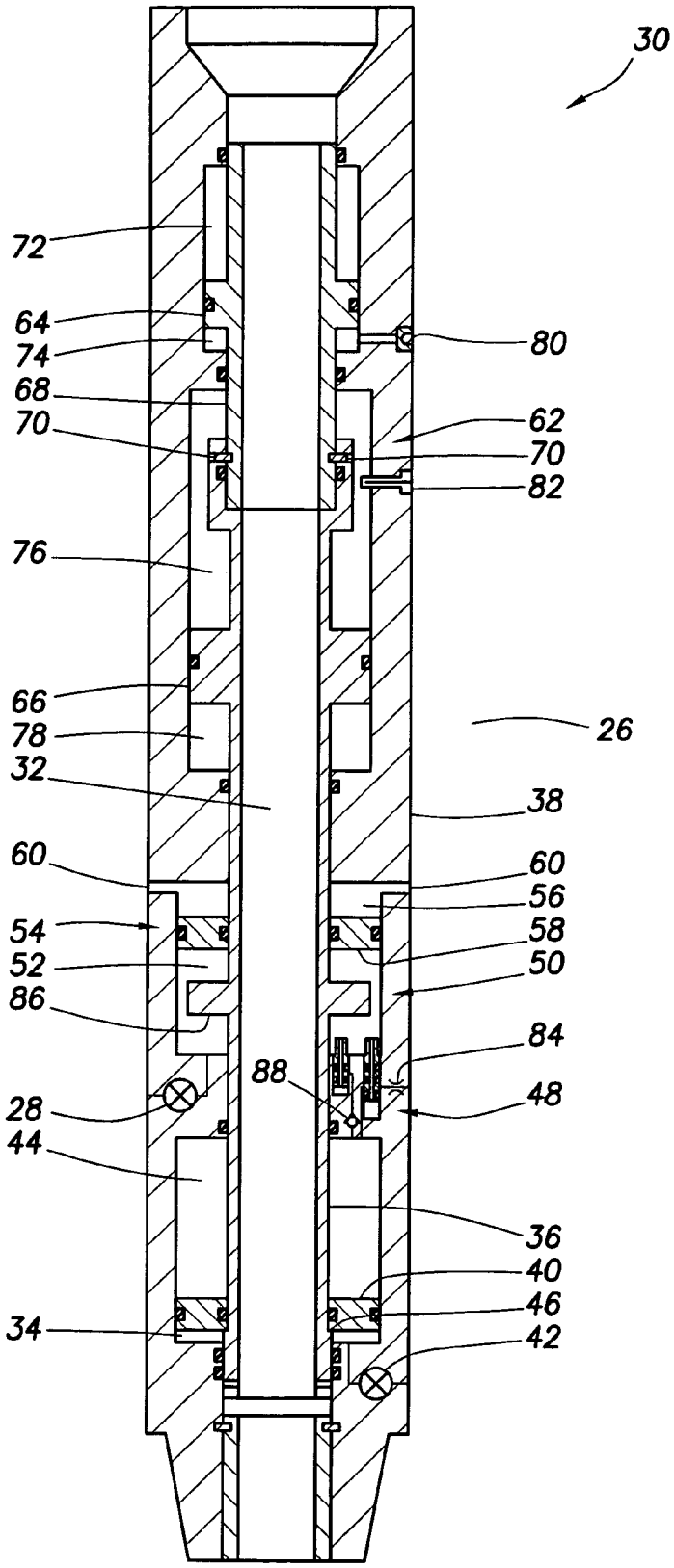
FIG. 2 is an enlarged scale schematic cross-sectional view of a first fluid sampler which may be used in the system of FIG. 1.

Referring additionally now to FIG. 2, a fluid sampler 30 is schematically and representatively illustrated. The sampler 30 may be used for the sampler 18 in the system 10 and method depicted in FIG. 1, or it could be used in any other system or method.

The sampler 18 includes an internal flow passage 32 which extends completely longitudinally through the sampler. When used in the system 10, the flow passage 32 becomes part of the passage 16 in the tubular string 12. When actuated, the sampler 30 receives a sample of the fluid in the passage 32 into an annular sample chamber 34 which circumscribes the passage.

A generally tubular inner mandrel 36 initially isolates the sample chamber 34 from the passage 32. However, it will be readily appreciated that when the mandrel 36 is displaced upward relative to an outer housing assembly 38, the sample chamber 34 will be exposed to the passage 32 and fluid from the passage will be received in the sample chamber.

Subsequently, when the mandrel 36 is displaced back down, the sample chamber 34 will again be isolated from the passage 32 and a fluid sample will be retained within the sample chamber. A valve 42 in the housing assembly 38 may be used to dispense the fluid sample from the sample chamber 34 upon retrieval of the sampler 30 to the surface.

An annular shaped floating piston 40 separates the sample chamber 34 from another chamber 44 which initially contains a metering fluid (such as a hydraulic fluid, silicone oil, etc.). A shoulder 46 formed on the mandrel 36 prevents the piston 40 from displacing downward past the shoulder, so that when the mandrel initially displaces upward to expose the sample chamber 34 to the passage 32, the piston displaces upward with the mandrel.

A valve section 48 controls fluid communication between the chamber 44 and a pressure source 50, and between the chamber 44 and an exterior of the sampler 30. In the system 10, the exterior of the sampler 18 is in communication with the annulus 26, and so if the sampler 30 is in the system 10, the valve section 48 controls fluid communication between the chamber 44 and the annulus. The valve section 48 is illustrated in an enlarged view in FIG. 3, and is described in further detail below.

The pressure source 50 includes a chamber 52 which preferably contains a pressurized fluid, such as compressed nitrogen gas. The compressed gas may be introduced to the chamber 52 via a valve 28 in the housing assembly 38. Alternatively, the pressurized fluid could be compressed silicone fluid or a combination of gas and liquid, etc. As another alternative, a pump or another means of supplying increased pressure could be used for the pressure source 50.

The sampler 30 also includes a device 54 for increasing pressure in the pressure source 50 while the sampler 30 is positioned in the well. In this manner, the pressure source 50 does not have to be as highly pressurized at the surface before installation of the sampler 30, and upon retrieval of the sampler to the surface.

The device 54 includes a chamber 56, an annular floating piston 58 which separates the chambers 52, 56, and ports 60 which provide fluid communication between the chamber 56 and an exterior of the sampler 30. When positioned in the well in the system 10, hydrostatic pressure in the annulus 26 will enter the ports 60 and will be applied to the piston 58 via the chamber 56. The hydrostatic pressure will, thus, be transmitted to the chamber 52 by the floating piston 58.

It will be appreciated that the device 54 permits the pressure source 50 to be pressurized to a relatively low pressure at the surface. Thereafter, when the sampler 30 is lowered into the well, hydrostatic pressure will be applied to the pressure source 50, increasing the pressure in the chamber 52. When the sampler 30 is retrieved from the well, hydrostatic pressure decreases, and so pressure in the chamber 52 also decreases. This provides enhanced safety when handling the sampler 30 at the surface.

The sampler 30 also includes an actuator 62 for initiating the fluid sampling operation. The actuator 62 includes two pistons 64, 66. The piston 66 is formed on an upper portion of the mandrel 36, and the piston 64 is formed on a separate sleeve 68 which is initially secured to the mandrel using shear pins 70.

The piston 64 separates two chambers 72, 74, and the piston 66 separates two chambers 76, 78. Initially, each of the chambers 72, 74, 76, 78 contains gas at a relatively low pressure, such as air at approximately atmospheric pressure. However, a rupture disk 80 and a frangible plug 82 are used to selectively provide fluid communication between the respective chambers 74, 76 and the exterior of the sampler 30.

In operation, pressure in the annulus 26 would be increased (for example, by applying pump pressure at the surface) to rupture the disk 80. Annulus pressure would then be admitted into the chamber 74. The resulting pressure differential across the piston 64 would cause the sleeve 68 and mandrel 36 to displace upward.

Upward displacement of the mandrel 36 is slowed by the metering fluid contained in the chamber 44. As the mandrel 36 displaces upward, the piston 40 also displaces upward and forces the metering fluid to flow through a restrictor 84 to the annulus 26. Eventually, the mandrel 36 displaces upward sufficiently far to expose the sample chamber 34 to the passage 32.

Fluid in the passage 32 enters the sample chamber 34. Note that, as the piston 40 displaces upward with the mandrel 36, the volume of the sample chamber 34 increases, thereby increasing the volume of fluid received in the sample chamber from the passage 32. The restrictor 84 slows the upward displacement of the piston 40, so that a controlled rate of flow of the fluid sample into the sample chamber 34 results, which prevents the fluid sample pressure from going below the bubble point.

Eventually, the mandrel 36 displaces upward sufficiently far for the piston to contact and break the plug 82. Annulus pressure will then be admitted to the chamber 76. The resulting pressure differential across the piston 66 causes an increased stress in the shear pins 70, causing the shear pins to shear and releasing the sleeve 68 from the mandrel 36.

The pressure differential across the piston 66 also causes the mandrel 36 to displace downward. Note that the piston 40 does not displace downward with the mandrel 36. Eventually, the mandrel 36 displaces downward sufficiently far to again isolate the sample chamber 34 from the passage 32.

As the mandrel 36 displaces downward, an annular projection 86 on the mandrel contacts and activates the valve section 48, so that pressure in the pressure source 50 is applied to the chamber 44 and, via the piston 40, to the fluid sample in the sample chamber 34. A check valve 88 prevents this increased pressure in the chambers 34, 44 from escaping back to the chamber 52 as the sampler 30 is retrieved from the well.

Figure 3:
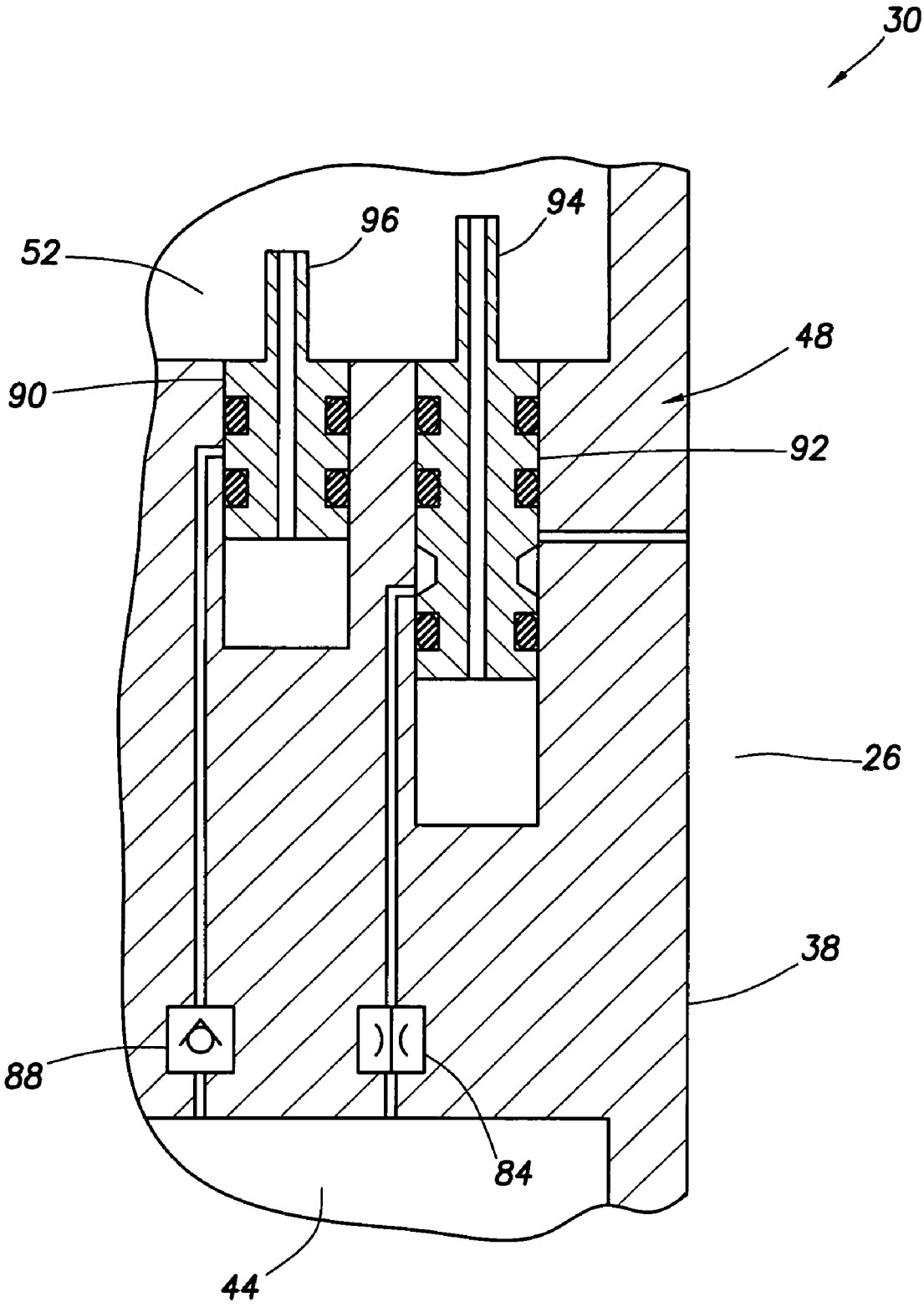
FIG. 3 is a further enlarged scale schematic cross-sectional view of a valve section of the first fluid sampler.

Referring additionally now to FIG. 3, an enlarged view of the valve section 48 is representatively illustrated. In this view it may be seen that the valve section 48 includes two valves 90, 92. The valve 90 initially isolates the chamber 52 from the chamber 44. The valve 92 initially provides communication between the chamber 44 and the annulus 26 exterior to the sampler 30.

Thus, as the mandrel 36 displaces upward to expose the sample chamber 34 to the passage 32 and receive a fluid sample in the sample chamber, metering fluid in the chamber 44 is discharged via the restrictor 84 and the valve 92 to the annulus. This allows a controlled rate of upward displacement of the mandrel 36 as the fluid sample is received into the sample chamber 34.

However, when the mandrel 36 displaces downward, the projection 86 on the mandrel contacts a stem 94 of the valve 92 and causes the valve to close, thereby isolating the chamber 44 from the annulus 26. Soon thereafter, the projection 86 contacts a stem 96 of the valve 90 and causes the valve to open and permit fluid to flow from the chamber 52 to the chamber 44 via the check valve 88. This allows the pressure in the chamber 52 to be applied to the chamber 44 and, via the piston 40, to the sample chamber 34 as described above.

Again referring to FIG. 2, it will be appreciated that the operation of the sampler 30 as described above results in the fluid sample being received in the sample chamber 34. In addition, the fluid sample is pressurized using pressure in the pressure source 50. After being pressurized by the pressure source 50, the check valve 88 prevents the increased pressure in the chambers 34, 44 from escaping back to the chamber 52. Operation of the valve section 48 as described above also prevents the increased pressure in the chambers 34, 44 from escaping to the annulus 26.

The device 54 permits the pressure in the pressure source 50 to be increased to hydrostatic pressure in the well at the sampler 30. After receiving the fluid sample in the sample chamber 34, the pressure in the annulus 26 could be increased to thereby further increase the pressure in the pressure source 50, and thereby further increase the pressure in the sample chamber 34.

For example, with the circulating valve 20 closed, pressure could be applied to the annulus 26 at the surface to increase pressure in the chambers 34, 44, 52, 56. When the applied pressure is relieved, the check valve 88 will prevent the increased pressure from escaping from the chambers 34, 44.

Note that, although the device 54 is depicted in FIG. 2 and described above as having the ports 60 providing fluid communication between the annulus 26 and the chamber 56, fluid communication could instead be provided between the chamber 56 and the passage 32. In this manner, hydrostatic pressure in the passage 32 would be applied to the chambers 34, 44, 52, 56 when the sampler 30 is operated to receive the fluid sample. Also, increased pressure can subsequently be applied to the passage 32 to further increase the pressure in the pressure source 50 and thereby increase the pressure in the sample chamber 34.

Another manner of applying increased pressure to the pressure source 50 is by increasing the hydrostatic pressure at the sampler 30. For example, a heavier weight fluid (such as a denser brine or other liquid, heavier weight mud, etc.) could be circulated into the well after opening the circulating valve 20. This may be a useful technique where a fluid sample is taken in an open hole, casing has been compromised uphole or is otherwise unable to handle much applied pressure, etc.

Yet another manner of increasing pressure in the pressure source 50 is by operating a pump, plunger, etc. by manipulation of the tubular string 12 (for example, slacking off weight at the surface, rotating the tubular string, actuating a hydraulic jar, etc.). As another alternative, pyrotechnic devices (such as azides of the type used in automotive airbags, etc.), propellants, etc. could be used to increase pressure in the pressure source 50.

Note that any combination of techniques could be used to increase pressure in the pressure source 50. For example, hydrostatic pressure in the well at the sampler 30 could be increased, and then additional pressure could be applied to the annulus 26 or passage 32 using a pump at the surface. It should be clearly understood that increased pressure in the pressure source 50 can be provided using any method, any type of method, and any combination of methods in keeping with the principles of the invention.

It may now be fully appreciated that the sampler 30 enables a fluid sample to be conveniently retrieved from the well with the fluid sample being pressurized at or above hydrostatic pressure in the well at the time the fluid sample was taken. In turn, this permits the fluid sample to remain pressurized above its bubble point, so that a single phase fluid sample is retrieved to the surface. These benefits (as well as others) are obtained while permitting the pressure to which the chamber 52 is pressurized at the surface to be reduced, both prior to installation of the sampler 30 in the well, and after retrieval of the sampler.

Figure 4:
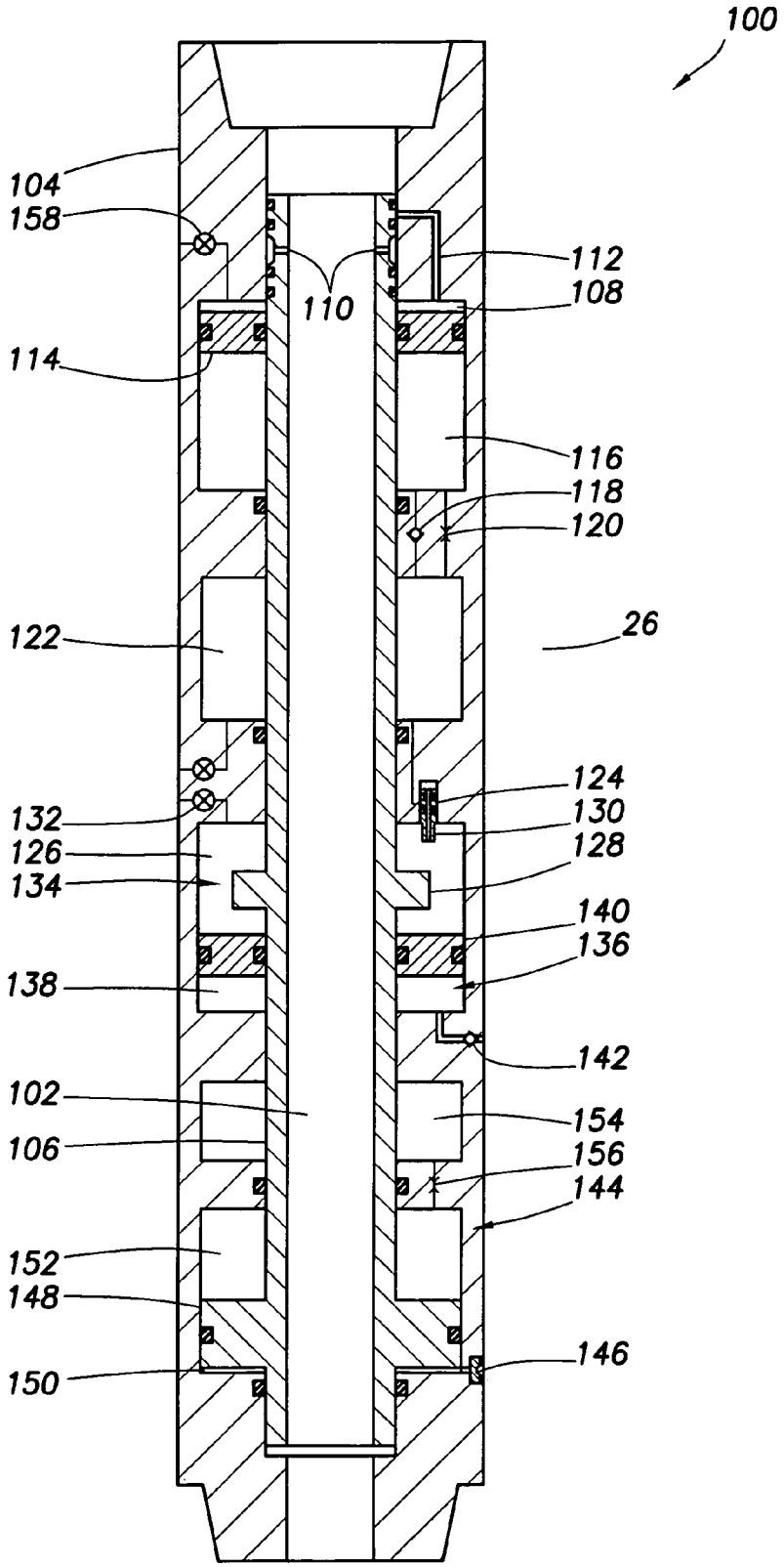
FIG. 4 is a schematic cross-sectional view of a second fluid sampler which may be used in the system of FIG. 1.

Referring additionally now to FIG. 4, another fluid sampler 100 embodying principles of the invention is schematically and representatively illustrated. The sampler 100 may be used for the sampler 18 in the system 10 and method of FIG. 1. However, it should be understood that the sampler 100 may also be used in other systems and methods in keeping with the principles of the invention.

The sampler 100 includes a flow passage 102 formed completely longitudinally through the sampler. When the sampler 100 is interconnected in the tubular string 12 in the system 10, the passage 102 will form a portion of the flow passage 16, and an exterior of the sampler will be in communication with the annulus 26.

The sampler 100 also includes an outer housing assembly 104 and an inner generally tubular mandrel 106. The mandrel 106 is reciprocably disposed within the housing assembly 104 for operation of the sampler 100.

An annular sample chamber 108 is formed between the housing assembly 104 and the mandrel 106. The sample chamber 108 circumscribes the flow passage 102 and is initially isolated from the flow passage by the mandrel 106. However, when the mandrel 106 is displaced upward as described below, openings 110 in the mandrel will be placed in communication with a passage 112 in the housing assembly 104, thereby providing communication between the sample chamber 108 and the passage 102.

An annular floating piston 114 separates the sample chamber 108 from another chamber 116. The chamber 116 contains a metering fluid (such as hydraulic fluid, silicone oil, etc.).

A check valve 118 and a flow restrictor 120 control flow between the chamber 116 and another chamber 122. The chamber 122 is initially filled with a gas at a relatively low pressure (such as air at atmospheric pressure).

A valve 124 initially prevents communication between the chamber 122 and another chamber 126. The valve 124 is similar to the valve 90 described above, in that displacement of the mandrel 106 will cause a radially enlarged projection 128 on the mandrel to contact and depress a stem 130 of the valve, and thereby permit communication between the chambers 122, 126.

The chamber 126 is part of a pressure source 134 of the sampler 100 and preferably contains a pressurized fluid, such as compressed nitrogen gas. The compressed gas may be introduced to the chamber 126 via a valve 132 in the housing assembly 104. Alternatively, the pressurized fluid could be compressed silicone fluid or a combination of gas and liquid, etc. As another alternative, a pump or another means of supplying increased pressure could be used for the pressure source 134.

The sampler 100 also includes a device 136 for increasing pressure in the pressure source 134 while the sampler 100 is positioned in the well. In this manner, the pressure source 134 does not have to be as highly pressurized at the surface before installation of the sampler 100, and upon retrieval of the sampler to the surface.

The device 136 includes a chamber 138, an annular floating piston 140 which separates the chambers 126, 138, and a check valve 142 which admits pressure from the exterior of the sampler 100 into the chamber 138, but does not permit pressure in the chamber 138 to escape to the exterior of the sampler. When positioned in the well in the system 10, hydrostatic pressure in the annulus 26 will enter the check valve 142 and will be applied to the piston 140 via the chamber 138. The hydrostatic pressure will, thus, be transmitted to the chamber 126 by the floating piston 140.

It will be appreciated that the device 136 permits the pressure source 134 to be pressurized to a relatively low pressure at the surface. Thereafter, when the sampler 100 is lowered into the well, hydrostatic pressure will be applied to the pressure source 134, increasing the pressure in the chamber 126.

The sampler 100 also includes an actuator 144 for initiating the fluid sampling operation. The actuator 144 includes a rupture disk 146 and a piston 148 formed on the mandrel 106. The piston 148 separates two chambers 150, 152. Another chamber 154 is in communication with the chamber 152 via a flow restrictor 156.

The chambers 150, 154 initially contain a gas at a relatively low pressure (such as air at atmospheric pressure). The chamber 152 initially contains a metering fluid (such as hydraulic fluid, silicone oil, etc.), also at the same relatively low pressure as the chambers 150, 154.

To initiate the fluid sampling operation, pressure in the annulus 126 is increased to a sufficient pressure to rupture the disk 146. This permits the pressure in the annulus 126 to enter the chamber 150. The resulting pressure differential across the piston 148 biases the mandrel 106 to displace upward.

Upward displacement of the piston 148 forces the metering fluid in the chamber 152 to flow through the restrictor 156 and into the chamber 154. This slows the upward displacement of the mandrel 106.

Eventually, the mandrel 106 will displace upward sufficiently far to place the openings 110 in communication with the passage 112. At this point, a fluid sample from the passage 102 will flow into the sample chamber 108. Since the chambers 116, 122 are initially at a relatively low pressure (such as atmospheric pressure), the resulting pressure differential will cause the piston 114 to displace downward, thereby expanding the sample chamber 108.

Downward displacement of the piston 114 will cause the metering fluid in the chamber 116 to flow through the restrictor 120 into the chamber 122. The restrictor 120 slows the downward displacement of the piston 114, so that a controlled rate of flow of the fluid sample into the sample chamber 108 results, which prevents the fluid sample pressure from going below the bubble point.

Eventually, the mandrel 106 will displace upward sufficiently far that the openings 110 are again isolated from the passage 112, thereby again isolating the sample chamber 116 from the passage 102. The restrictors 120, 156 are selected so that the mandrel 106 displaces upward at a slow enough rate for the sample chamber 108 to completely and satisfactorily receive the fluid sample therein while the sample chamber is in communication with the passage 102.

Further upward displacement of the mandrel 106 causes the projection 128 to contact the stem 130 and open the valve 124. This pressurizes the chamber 122 and, via the check valve 118, the chamber 116 and the sample chamber 108 utilizing the pressure in the pressure source 134.

As described above, the pressure source 134 can initially contain a pressurized fluid and, upon installation of the sampler 100 in the well, hydrostatic pressure in the well at the sampler 100 can be applied to the pressure source 134 using the device 136. Thus, when the valve 124 is opened, the fluid sample in the sample chamber 108 can be pressurized to hydrostatic pressure in the well at the sampler 100.

The fluid sample in the sample chamber 108 can be further pressurized using any of the techniques described above for the sampler 30 of FIG. 2. For example, pressure in the annulus 26 can be increased by applying pump pressure at the surface, hydrostatic pressure at the sampler 100 can be increased by circulating a higher density fluid into the well, the chamber 138 of the device 136 could be in communication with the passage 102 instead of the annulus 26, in which case pressure in the passage 16 of the tubular string could be increased to thereby increase pressure in the pressure source 134, a pump could be operated in the sampler 100 to increase pressure, a pyrotechnic device, propellant, etc. could be used to increase pressure, etc. Any method, any type of method, and any combination of methods may be used to increase pressure in the pressure source 134 and in the sample chamber 108 to greater than hydrostatic pressure, or to increase hydrostatic pressure at the sampler 100.

The sampler 100 can now be retrieved with the fluid sample in the sample chamber 108 pressurized above the bubble point of the fluid sample. The fluid sample can be conveniently released from the sample chamber 108 via a valve 158 in the housing assembly 104.

Figure 5:
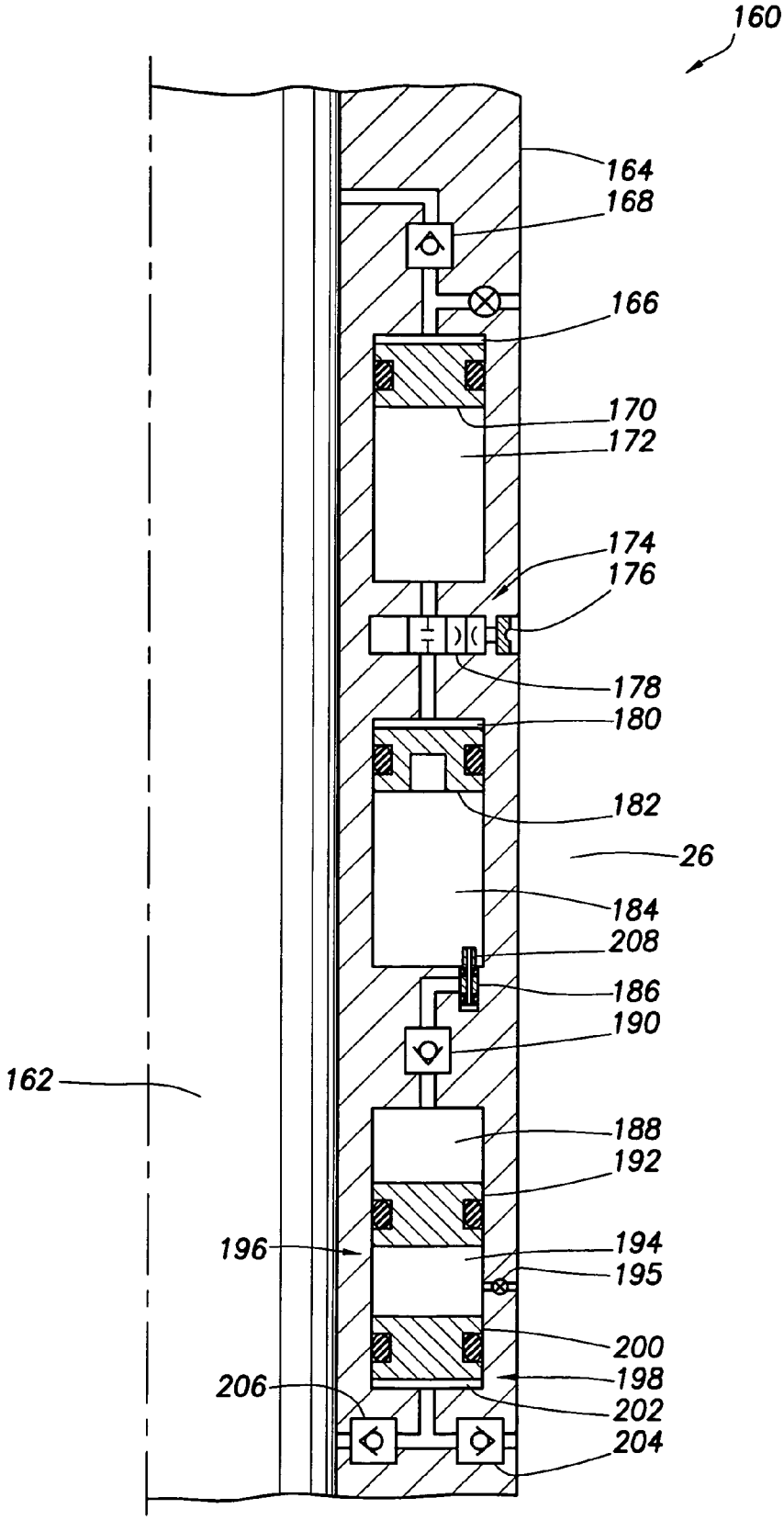
FIG. 5 is a schematic quarter-sectional view of a third fluid sampler which may be used in the system of FIG. 1.

Referring additionally now to FIG. 5, another fluid sampler 160 embodying principles of the invention is representatively and schematically illustrated. The sampler 160 may be used for the sampler 18 in the system 10 and method of FIG. 1. However, the sampler 160 could also be used in other systems and methods without departing from the principles of the invention.

The sampler 160 includes a flow passage 162 formed completely longitudinally through a housing assembly 164. When the sampler 160 is interconnected in the tubular string 12 in the system 10, the passage 162 forms a portion of the passage 16 in the tubular string.

An annular sample chamber 166 is formed in the housing assembly 164 and circumscribes the passage 162. The sample chamber 166 can receive a fluid sample from the passage 162, but a check valve 168 prevents the fluid sample from escaping from the sample chamber back to the passage 162.

An annular floating piston 170 separates the sample chamber 166 from another chamber 172. The chamber 172 initially contains a metering fluid, such as hydraulic fluid, silicone oil, etc. The metering fluid in the chamber 172 initially prevents downward displacement of the piston 170, which in turn prevents fluid in the passage 162 from flowing through the check valve 168 into the sample chamber 166.

The sampler 160 also includes an actuator 174 for initiating the fluid sampling operation. The actuator 174 includes a rupture disk 176 and a shuttle valve 178. Initially, the valve 178 prevents communication between the chamber 172 and another chamber 180. However, when the valve 178 is actuated by rupturing the disk 176, restricted flow of the metering fluid from the chamber 172 to the chamber 180 is permitted.

An annular piston 182 separates the chamber 180 from another chamber 184. The chamber 184 initially contains a gas at relatively low pressure (such as air at atmospheric pressure).

A valve 186 (similar to the valves 90, 124 described above) initially prevents communication between the chamber 184 and another chamber 188. When the valve 186 is opened, as described more fully below, a check valve 190 permits pressure in the chamber 188 to be admitted to the chamber 184, but does not permit the admitted pressure to escape back to the chamber 188 from the chamber 184.

The chamber 188 initially contains a fluid, such as hydraulic fluid or silicone oil. An annular piston 192 separates the chamber 188 from another chamber 194. As part of a pressure source 196 of the sampler 160, the chamber 194 initially contains a pressurized fluid, such as a compressed nitrogen gas. The compressed gas may be introduced to the chamber 194 via a valve 195 in the housing assembly 164.

Alternatively, the pressurized fluid could be compressed silicone fluid or a combination of gas and liquid, etc. As another alternative, a pump or another means of supplying increased pressure could be used for the pressure source 196. The piston 192 transmits the pressure in the chamber 194 to the fluid in the chamber 188.

The sampler 160 further includes a device 198 for increasing pressure in the pressure source 196 while the sampler is positioned in the well. The device 198 includes an annular floating piston 200 which separates the chamber 194 from another chamber 202.

A check valve 204 admits pressure from the exterior of the sampler 160 into the chamber 202. Another check valve 206 admits pressure from the passage 162 into the chamber 202. In practice, only one of the check valves 204, 206 may be used, and pressure from only one of the annulus 26 and the passage 162 may be admitted to the chamber 202, but the configuration depicted in FIG. 5 demonstrates that pressure in either the passage or the annulus, or both of them, may be used by the device 198 to increase pressure in the pressure source 196.

In operation, pressure in the annulus 26 will be increased a sufficient amount to rupture the disk 176 and initiate the fluid sampling operation. Pressure from the annulus 26 will cause the valve 178 to shift and thereby permit restricted flow of the metering fluid from the chamber 172 to the chamber 180.

The piston 170 will slowly displace downward and a fluid sample will flow from the passage 162 into the sample chamber 166 via the check valve 168. The sample chamber 166 expands as the piston 170 displaces downward. The restricted flow through the valve 178 prevents the pressure of the fluid sample from going below its bubble point.

The piston 182 displaces downward as the metering fluid flows into the chamber 180. Eventually (after the fluid sample has been completely and satisfactorily received in the sample chamber 166), the piston 182 will contact a stem 208 of the valve 186 and thereby open the valve.

When the valve 186 opens, pressure from the chamber 188 will be admitted into the chamber 184 via the check valve 190. This is the pressure supplied by the pressurized fluid in the pressure source 196. In this manner (i.e., via the check valve 190, open valve 186, chamber 184, piston 182, chamber 180, valve 178, chamber 172 and piston 170), the pressure in the pressure source 196 is applied to the fluid sample in the sample chamber 166. Thus, when the fluid sample is received in the sample chamber 166, hydrostatic pressure in the well at the sampler 160 is applied to the fluid sample from the pressure source 196.

The fluid sample in the sample chamber 166 can be further pressurized using any of the techniques described above for the sampler 30 of FIG. 2 or for the sampler 100 of FIG. 4. For example, pressure in the annulus 26 and/or in the passage 162 can be increased by applying pump pressure at the surface, hydrostatic pressure at the sampler 160 can be increased by circulating a higher density fluid into the well, a pump could be operated in the sampler 160 to increase pressure, a pyrotechnic device, propellant, etc. could be used to increase pressure, etc. Any method, any type of method, and any combination of methods may be used to increase pressure in the pressure source 196 and in the sample chamber 166 to greater than hydrostatic pressure, or to increase hydrostatic pressure at the sampler 160.

During retrieval of the sampler 160 to the surface, the check valve 168 prevents pressure in the sample chamber 166 from escaping to the passage 162. The check valve 190 also prevents pressure in the sample chamber 166 and chambers 172, 180, 184 from escaping back to the chambers 188, 194. Thus, the fluid sample can be conveniently retrieved at a pressure greater than its bubble point.

Figure 6:
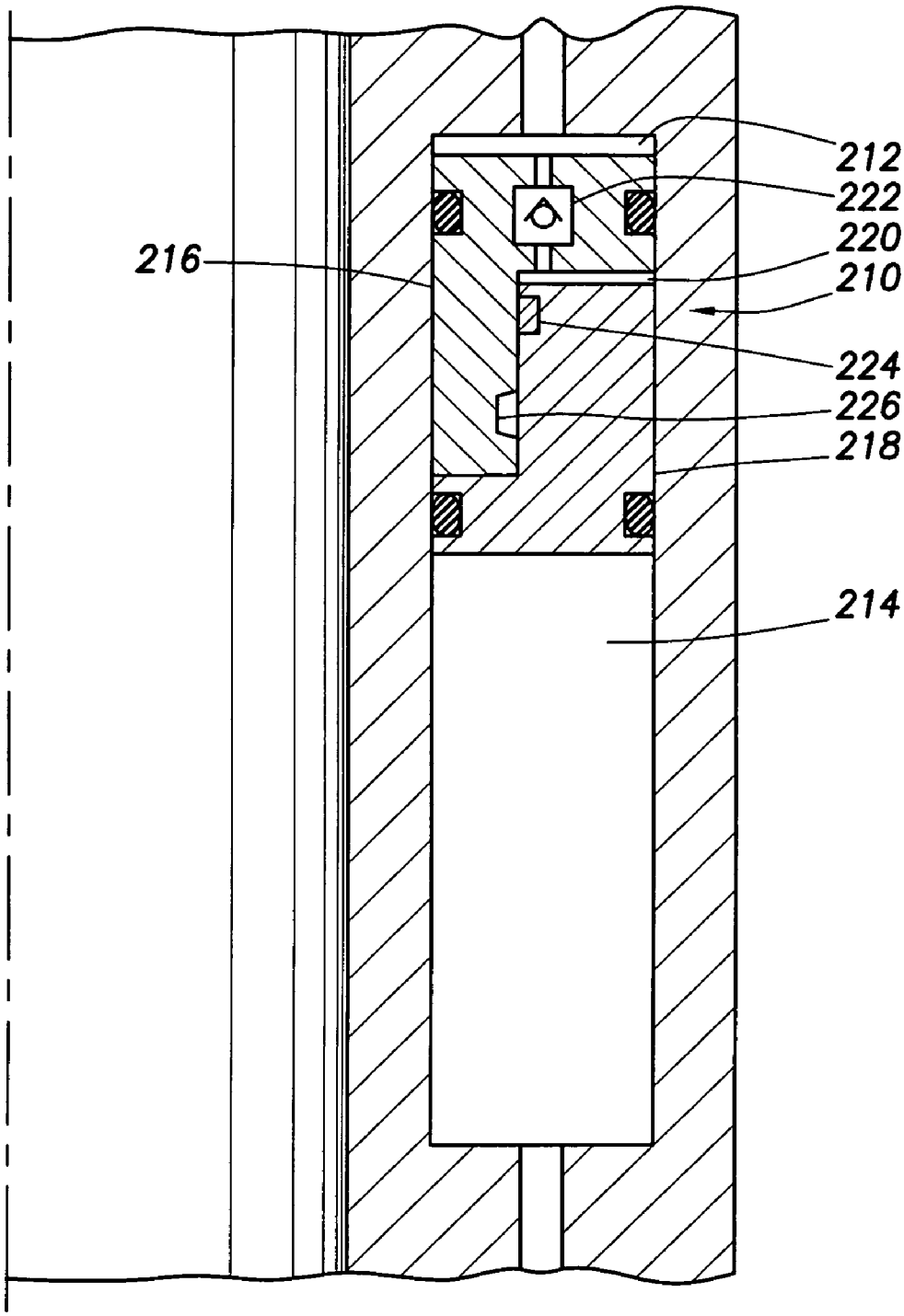
FIG. 6 is an enlarged scale schematic cross-sectional view of a debris trap piston which may be used in the second and third fluid samplers.
Figure 7A:
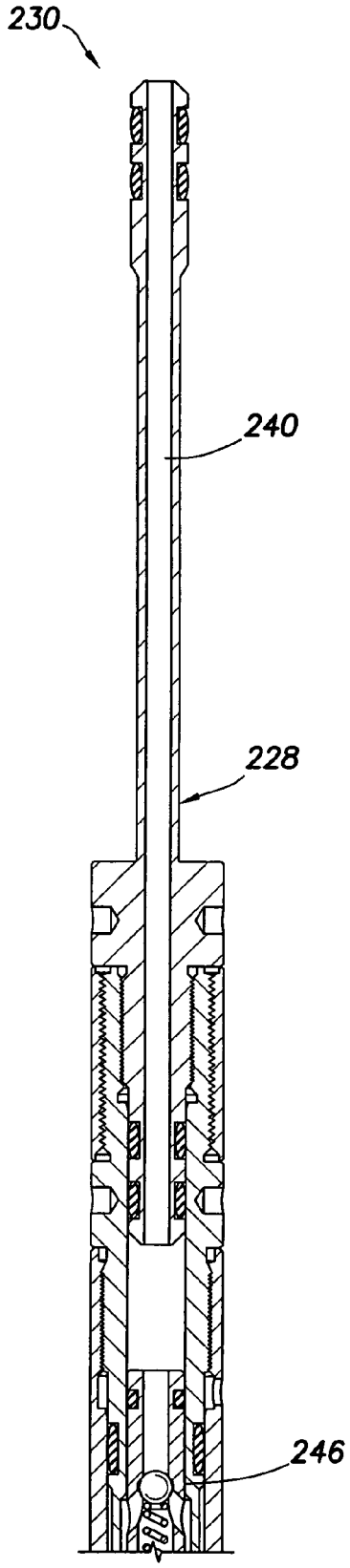
FIGS. 7A–H are cross-sectional views of successive axial portions of a sampling section of a fourth fluid sampler which may be used in the system of FIG. 1.
Figure 7B:
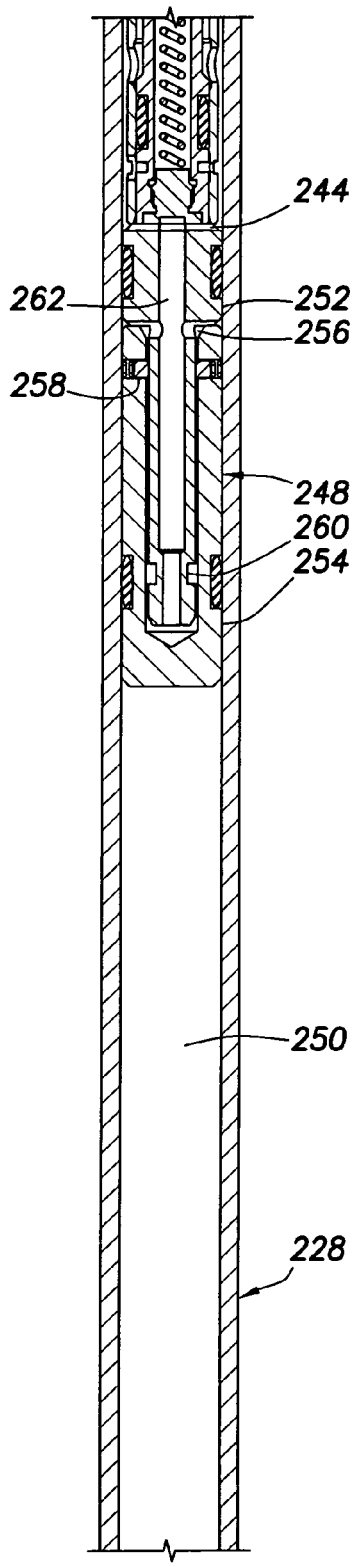
Figure 7C:
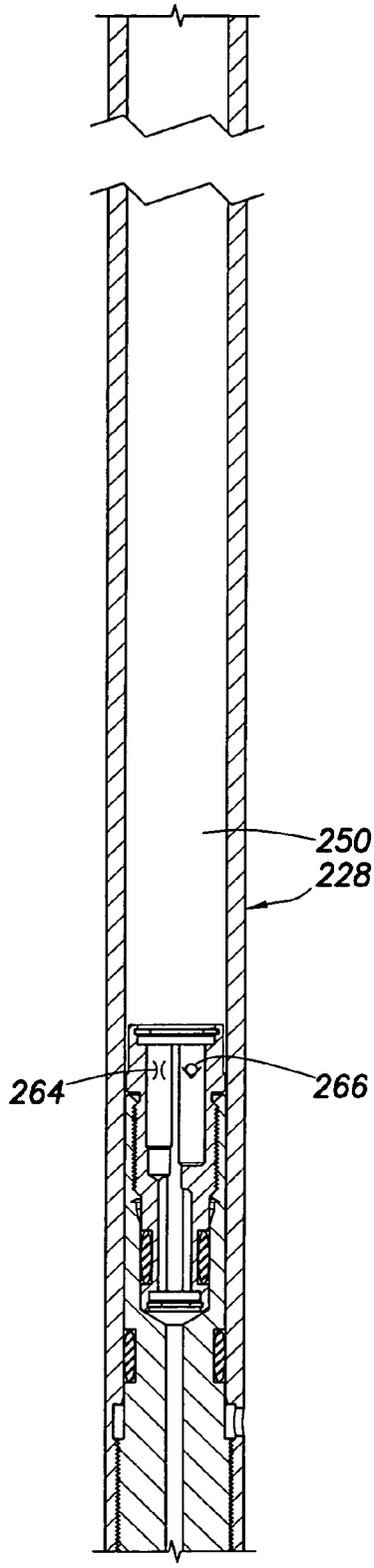
Figure 7D:
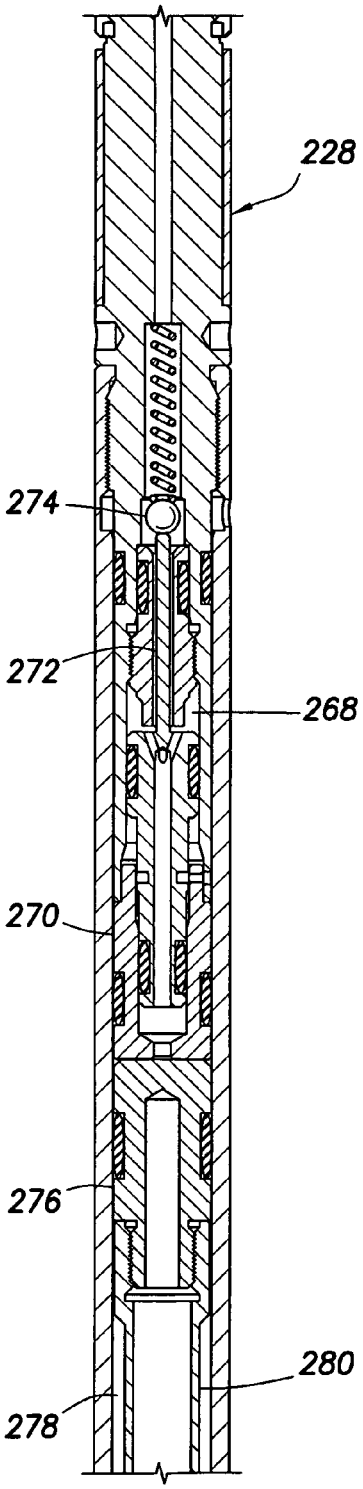
Figure 7E:
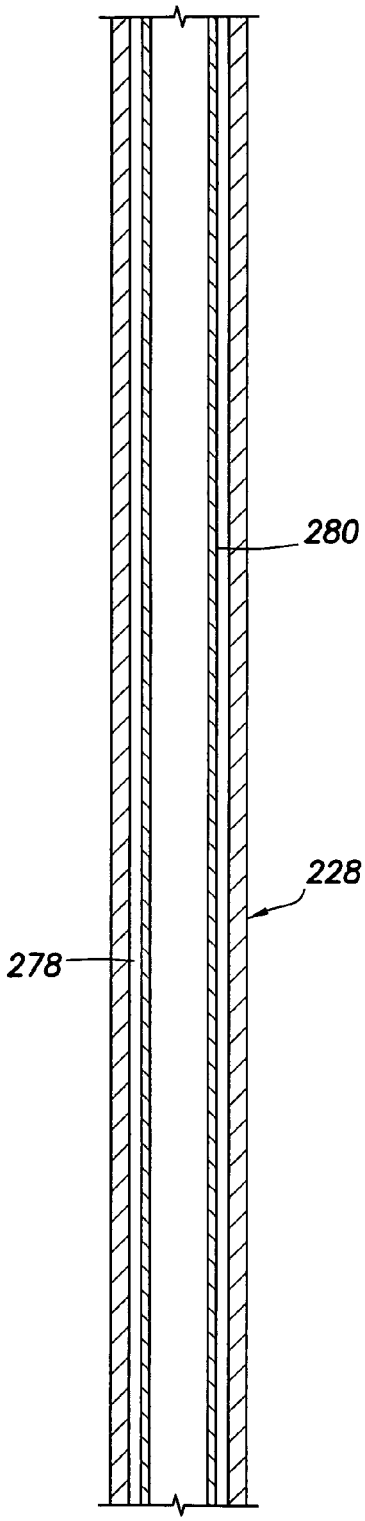
Figure 7F:
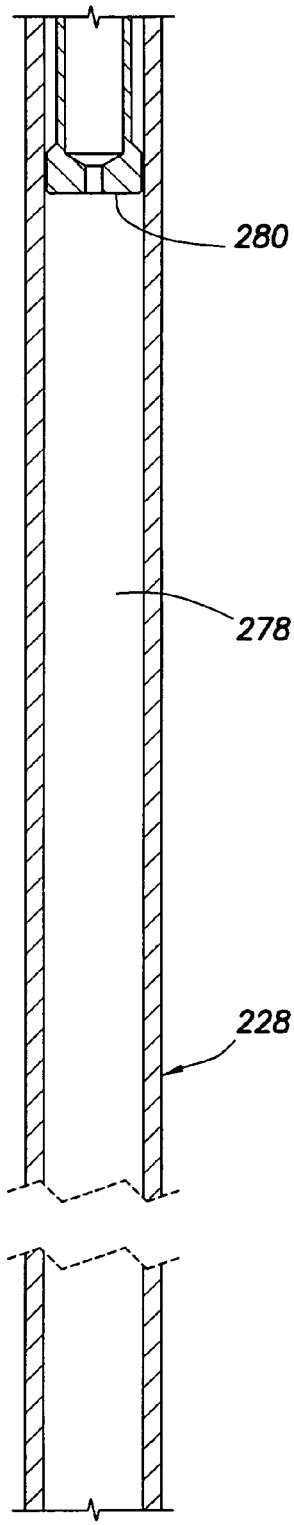
Figure 7G:
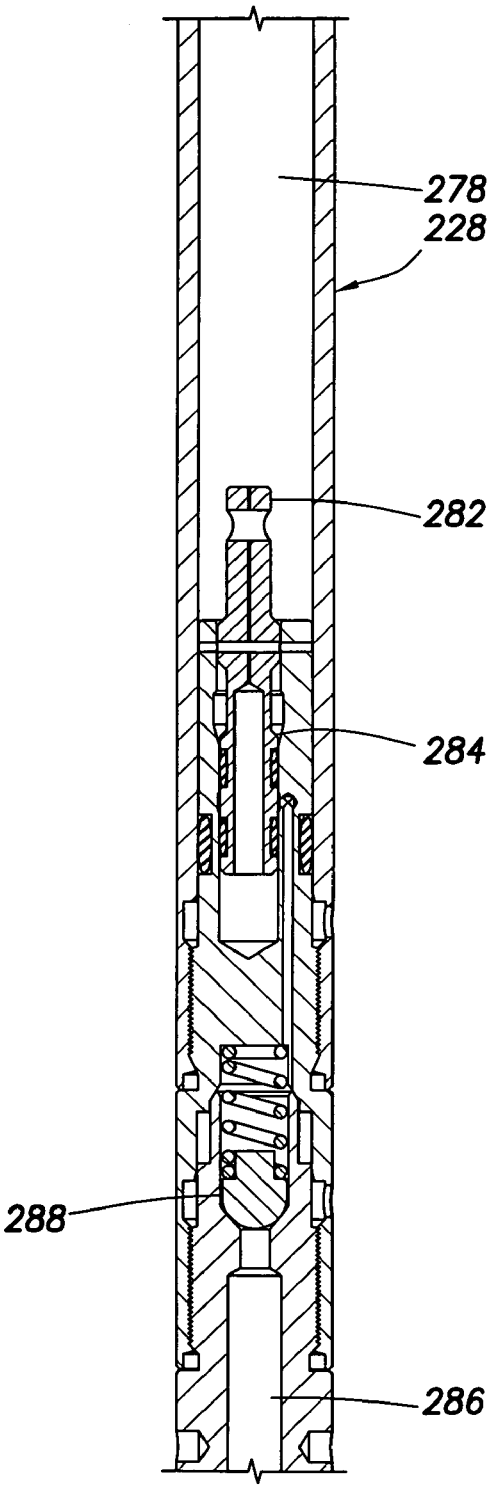
Figure 7H:
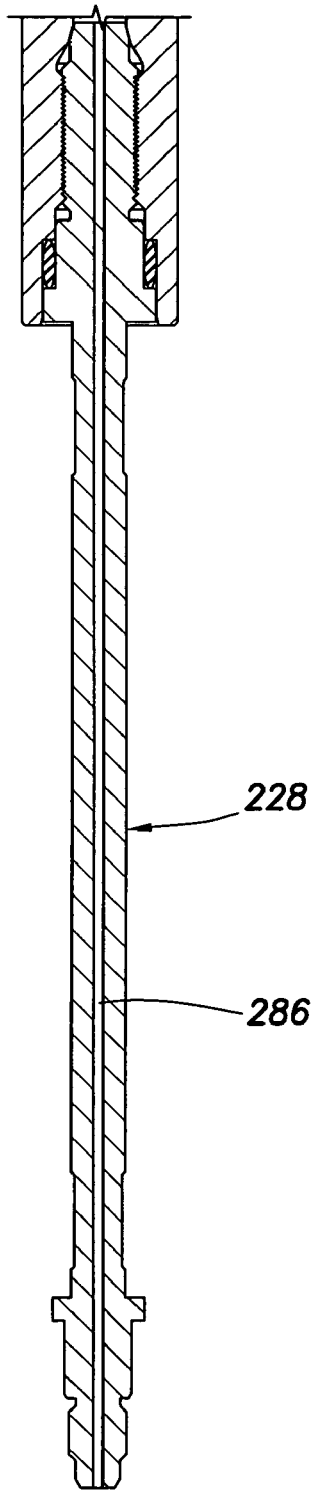

Referring additionally now to FIG. 6, a debris trap piston 210 which may be used in the samplers 100, 160 described above is representatively and schematically illustrated. For example, the piston 210 could be used for the piston 114 in the sampler 100, or for the piston 170 in the sampler 160. Of course, the piston 210 may be used in other fluid samplers in keeping with the principles of the invention.

As depicted in FIG. 6, the piston 210 separates a sample chamber 212 from another chamber 214. This is similar to the manner in which the piston 114 separates the sample chamber 108 from the chamber 116, and the piston 170 separates the sample chamber 166 from the chamber 172.

A fluid sample is received in the sample chamber 212 as the piston 210 displaces downward. However, the piston 210 includes two partially overlapping piston sections 216, 218 which displace relative to each other to thereby form an expanding debris chamber 220 between the piston sections.

In operation, as fluid flows into the sample chamber 212, a check valve 222 permits the fluid to flow into the debris chamber 220. The resulting pressure differential across the piston section 218 causes the piston section to displace downward, thereby expanding the debris chamber 220.

Eventually, the piston section 218 will displace downward sufficiently far for a snap ring, C-ring, spring-loaded lugs or dogs or other type of engagement device 224 to engage a recess 226 formed on the piston section 216. Once the engagement device 224 has engaged the recess 226, the piston sections 216, 218 displace downwardly together to expand the sample chamber 212. The fluid received in the debris chamber 220 is prevented from escaping back into the sample chamber 212 by the check valve 222.

In this manner, the fluid initially received into the sample chamber 212 is trapped in the debris chamber 220. This initially received fluid is typically laden with debris, or is a type of fluid (such as mud) which it is not desired to sample. The piston 210 permits this initially received fluid to be isolated from the fluid sample later received in the sample chamber 212.

Referring additionally now to FIGS. 7A–H, one of multiple fluid sampling sections 228 for use in another fluid sampler 230 embodying principles of the present invention is representatively illustrated. The fluid sampler 230 includes the sampling section(s) 228 and an assembly comprising a carrier 232, actuator 234, pressure source 236 and a device 238 for increasing pressure in the pressure source. This assembly is depicted in FIGS. 8A–E. Thus, the fluid sampler 230 includes one or more fluid sampling section(s) 228 of FIGS. 7A–H combined with the assembly of FIGS. 8A–E.

The fluid sampler 230 may be used for the sampler 18 in the system 10 and method of FIG. 1. In addition, the sampler 230 may be used in other systems and methods in keeping with the principles of the invention.

As described more fully below, a passage 240 in an upper portion of the sampling section 228 (see FIG. 7A) is placed in communication with a flow passage 242 formed completely longitudinally through the sampler 230 (see FIG. 8A) when the fluid sampling operation is initiated using the actuator 234. The passage 242 becomes a portion of the passage 16 in the tubular string 12 when the sampler 230 is interconnected in the tubular string.

The passage 240 in the upper portion of the sampling section 228 is in communication with a sample chamber 244 via a check valve 246. The check valve 246 permits fluid to flow from the passage 240 into the sample chamber 244, but prevents fluid from escaping from the sample chamber to the passage 240.

A debris trap piston 248 separates the sample chamber 244 from another chamber 250. The piston 248 is similar in some respects to the piston 210 of FIG. 6, in that it includes two piston sections 252, 254 with an expandable debris chamber 256 between the piston sections.

When fluid is flowed into the sample chamber 244, the fluid initially flows through a passage 262 in the piston section 252 and enters the debris chamber 256. This causes the piston section 254 to displace downward, thereby expanding the debris chamber 256.

Eventually, spring-loaded dogs 258 carried on the piston section 254 engage a recess 260 formed on the piston section 252, and the piston sections displace downwardly together. A check valve could be provided in the passage 262 in the piston section 252 to prevent the fluid received in the debris chamber 256 from escaping back to the sample chamber 244, if desired.

The chamber 250 initially contains a metering fluid, such as a hydraulic fluid, silicone oil, etc. A flow restrictor 264 and a check valve 266 control flow between the chamber 250 and another chamber 268. The chamber 268 initially contains a gas at a relatively low pressure (such as air at atmospheric pressure).

A collapsible piston assembly 270 in the chamber 268 includes a prong 272 which initially maintains another check valve 274 off seat, so that flow in both directions is permitted through the check valve between the chambers 250, 268. However, when elevated pressure is applied to the chamber 268 as described more fully below, the piston assembly 270 collapses axially, and the prong 272 will no longer maintain the check valve 274 off seat, thereby preventing flow from the chamber 250 to the chamber 268.

A floating piston 276 separates the chamber 268 from another chamber 278. The chamber 278 initially contains a gas at a relatively low pressure (such as air at atmospheric pressure). A spacer 280 is attached to the piston 276 and limits downward displacement of the piston.

The spacer 280 also is used to contact a stem 282 of a valve 284 to open the valve. The valve 284 initially prevents communication between the chamber 278 and a passage 286 in a lower portion of the sampling section 228. In addition, a check valve 288 permits fluid flow from the passage 286 to the chamber 278, but prevents fluid flow from the chamber to the passage.

As mentioned above, one or more of the sampling section(s) 228 may be used in the assembly depicted in FIGS. 8A–E. A seal bore 290 (see FIG. 8B) is provided in the carrier 232 for receiving the upper portion of the sampling section 228, and another seal bore 292 is provided for receiving the lower portion of the sampling section. In this manner, the passage 240 in the upper portion of the sampling section 228 is placed in sealed communication with a passage 294 in the carrier 232, and the passage 286 in the lower portion of the sampling section is placed in sealed communication with a passage 296 in the carrier.

Any number of sampling sections 228 may be included in the sampler 230. In the illustrated embodiment of the assembly of FIGS. 8A–E, nine sampling sections 228 are accommodated by the carrier 232.

In addition, a pressure and temperature gauge/recorder (not shown) of the type known to those skilled in the art can also be received in the carrier 232. Seal bores 298, 300 or other receptacles may be provided in the carrier 232 for providing communication between the gauge/recorder and, for example, the passage 242 in the assembly.

Figure 8A:
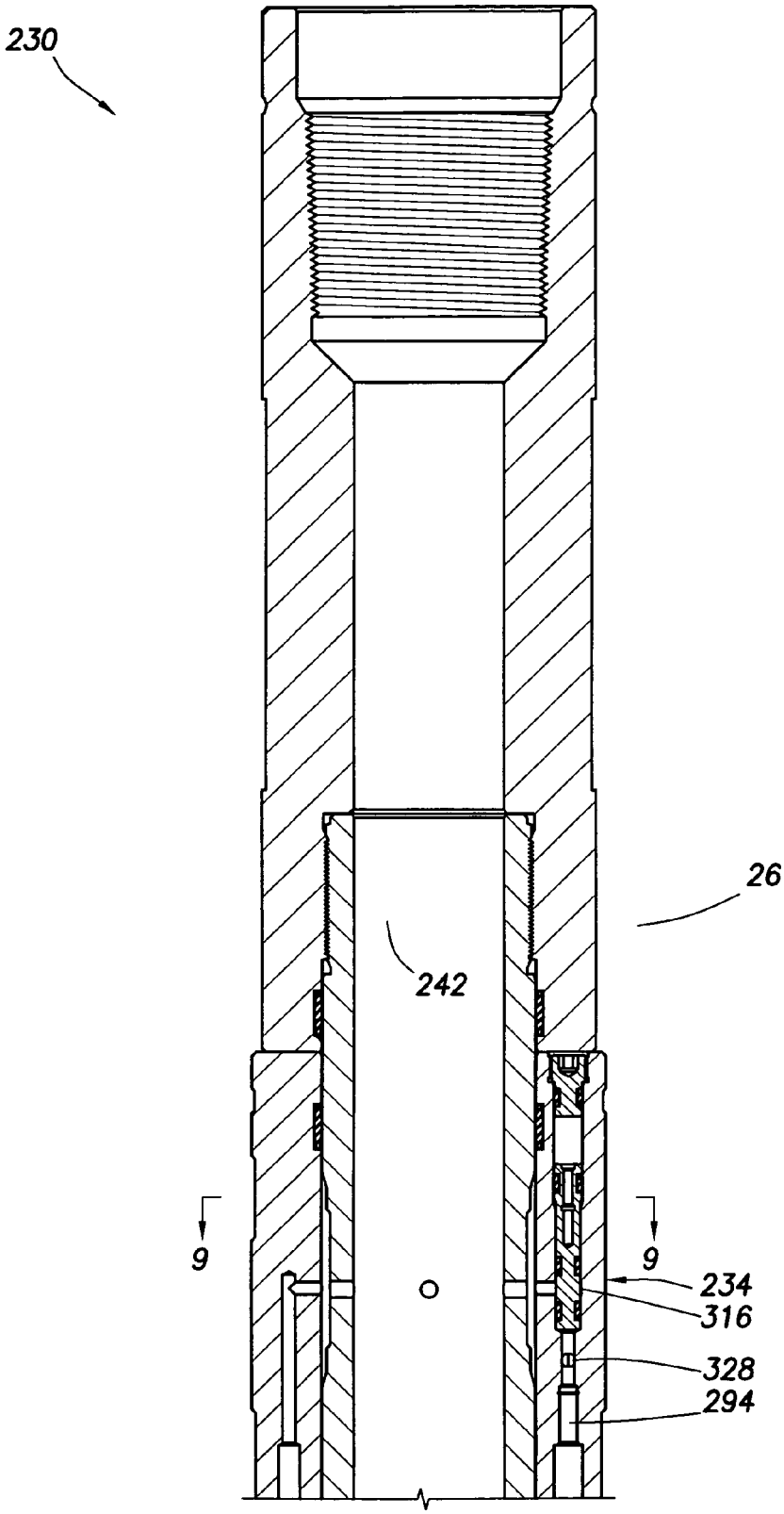
FIGS. 8A–E are cross-sectional views of successive axial portions of actuator, carrier and pressure source sections of the fourth fluid sampler.
Figure 8B:
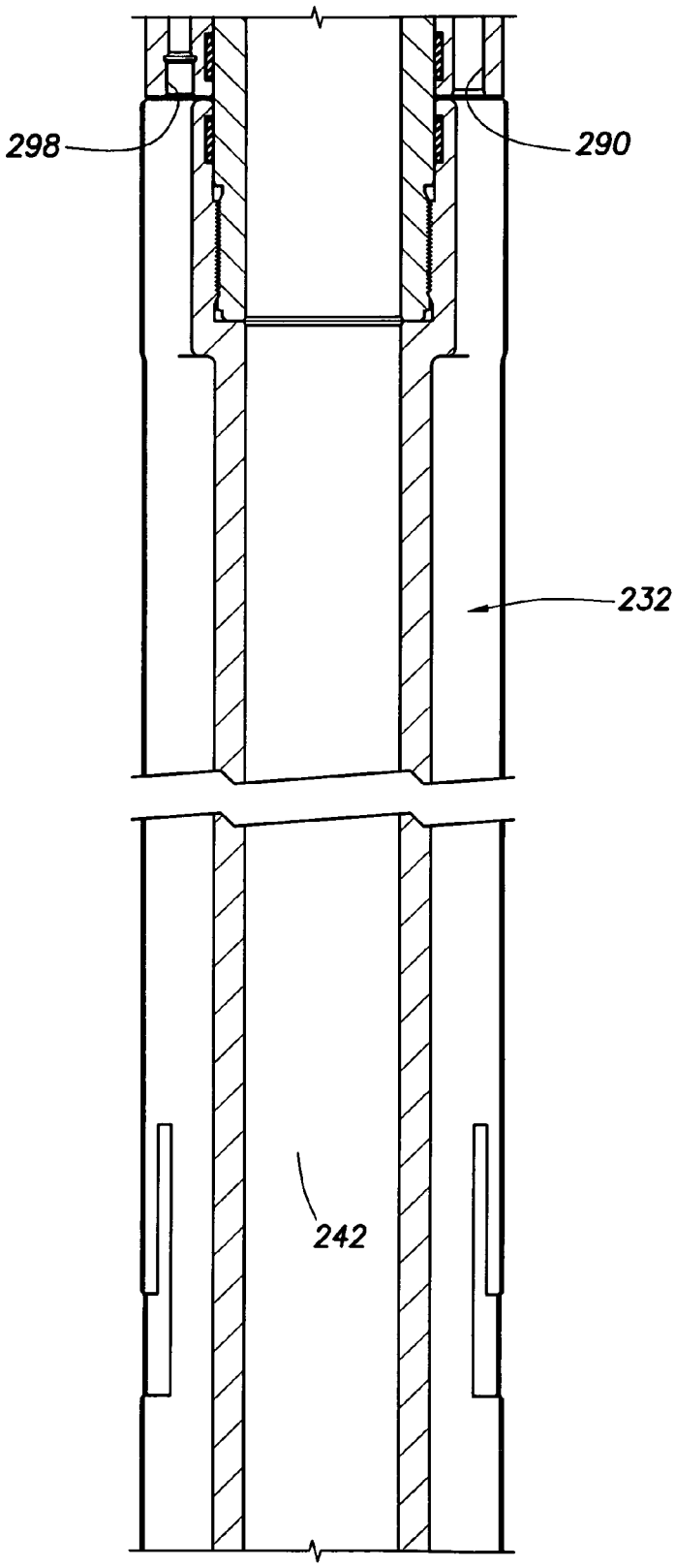
Figure 8C:
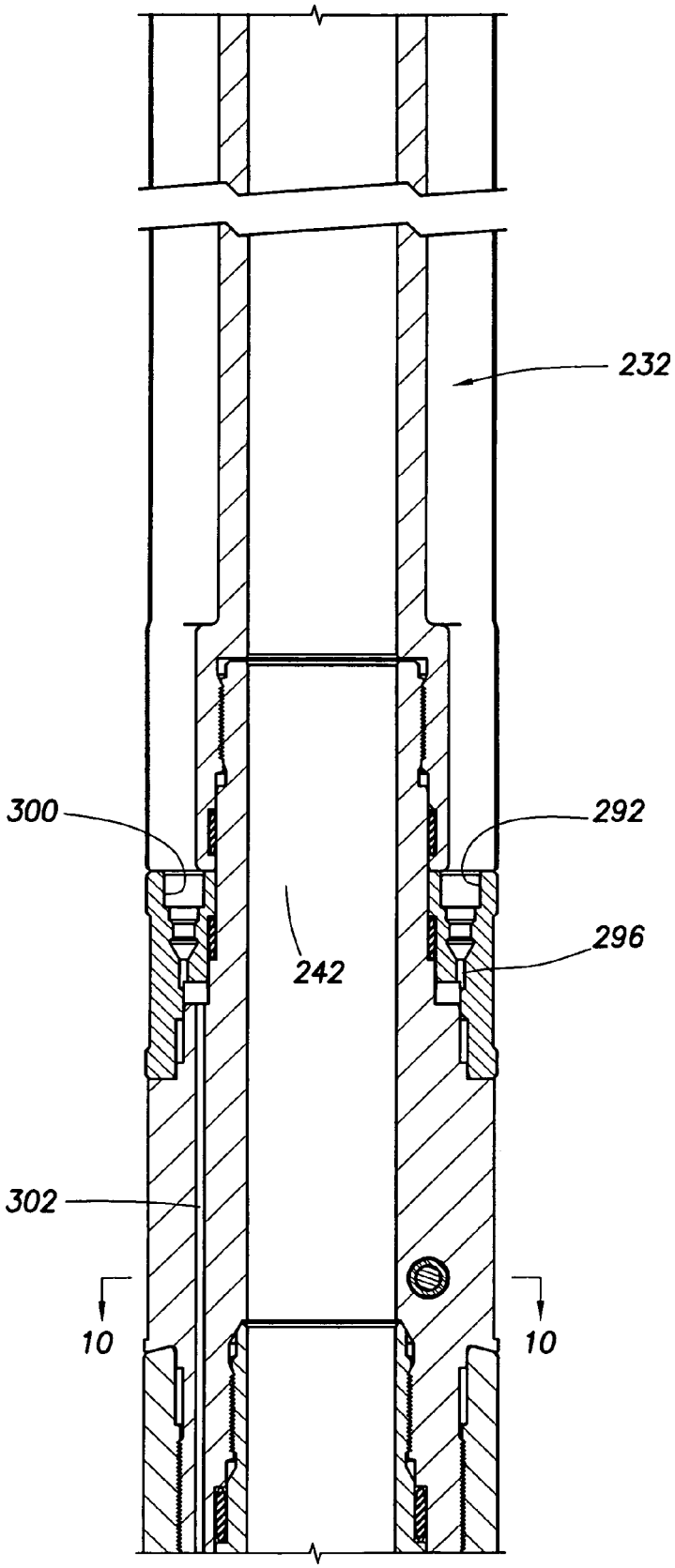
Figure 8D:
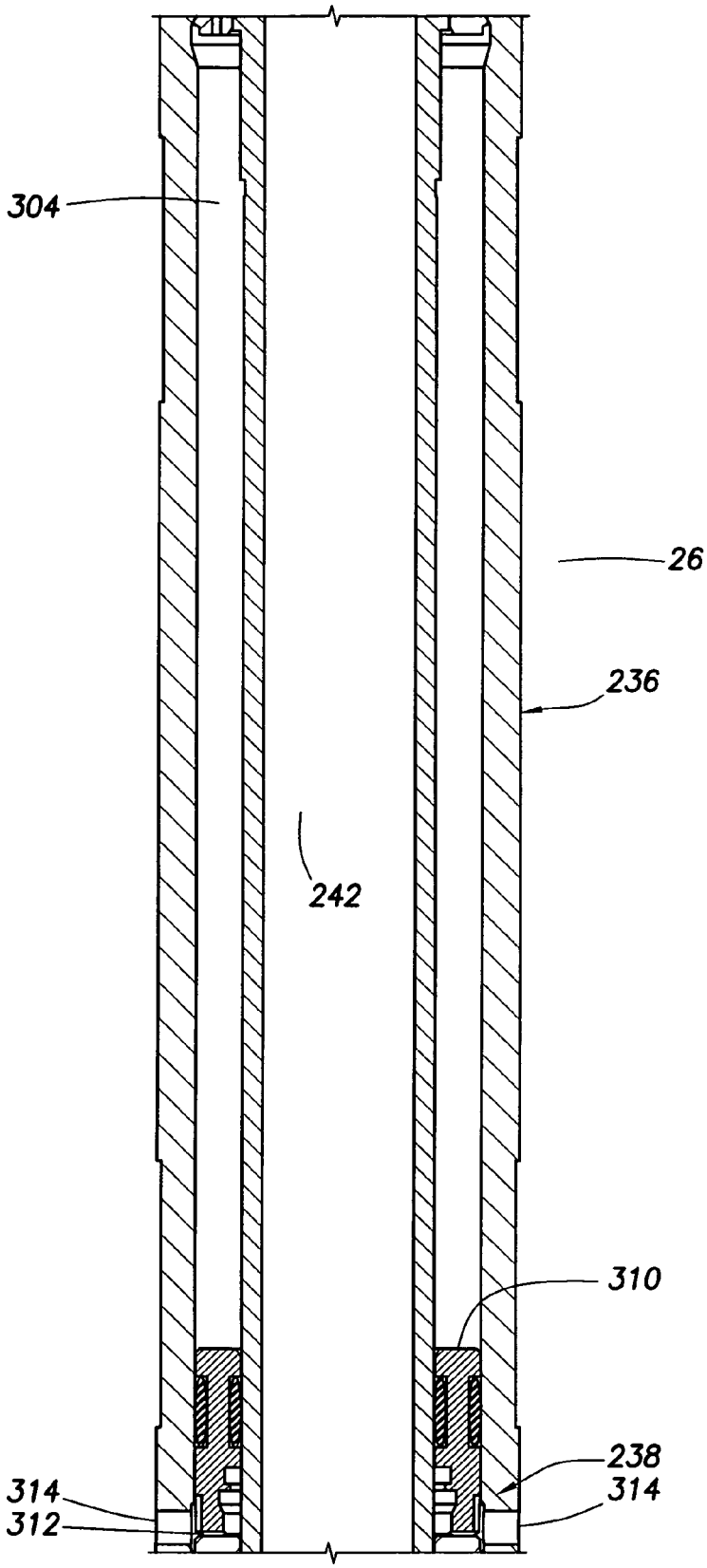
Figure 8E:
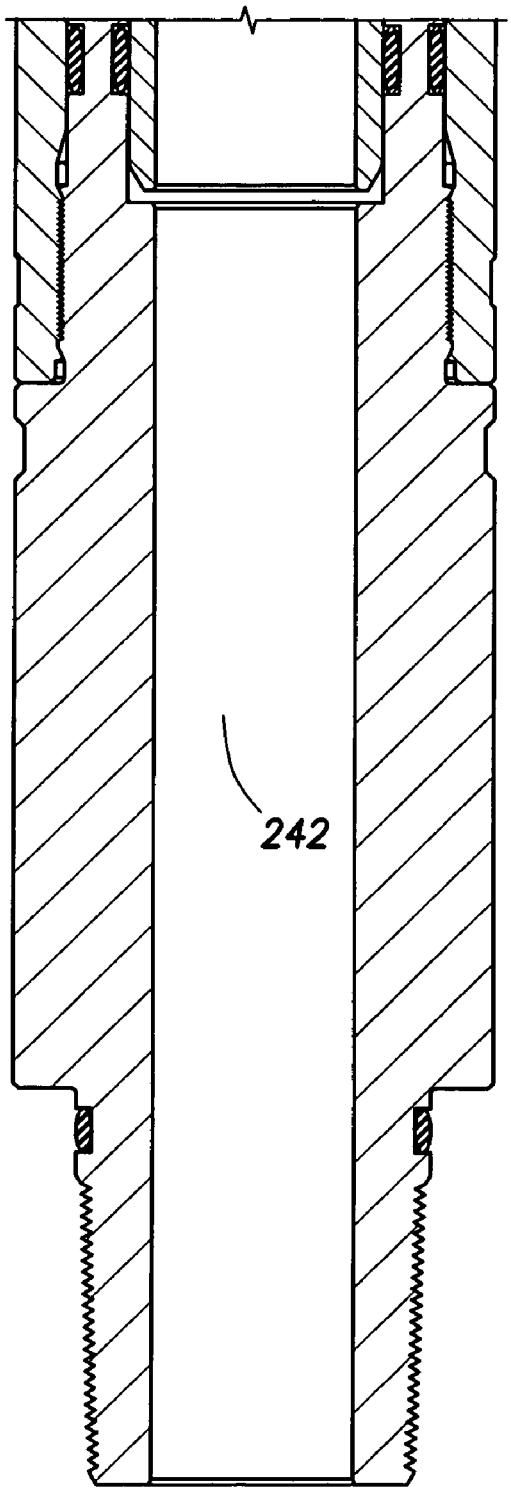

Note that, although the seal bore 300 depicted in FIG. 8C is in communication with another passage 302 in the assembly, preferably if the seal bore 300 is used to accommodate a gauge/recorder, then a plug is used to isolate the gauge/recorder from the passage 302. However, the passage 302 is in communication with the passage 296 and the lower portion of any sampling section 228 installed in the seal bore 292. If a sampling section 228 or gauge/recorder is not installed in any of the seal bores 290, 292, 298, 300 then a plug will be installed to prevent flow therethrough.

Figure 10:
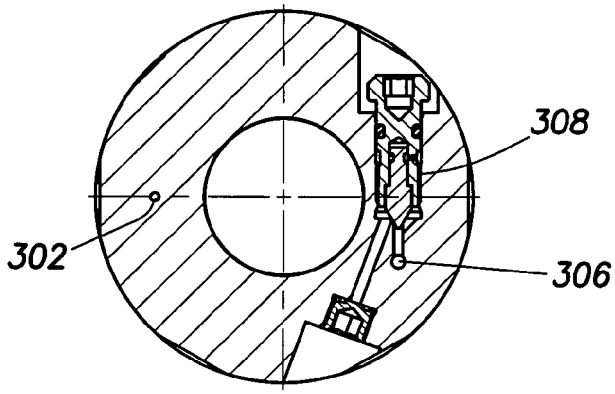
FIG. 10 is a cross-sectional view of the pressure source section, taken along line 10—10 of FIG. 8C.

The passage 302 is in communication with a chamber 304 of the pressure source 236. The chamber 304 initially contains a pressurized fluid, such as a compressed gas or liquid. Preferably, compressed nitrogen is used in the chamber 304, but silicone fluid and/or another fluid or combination of fluids could be used, if desired. In FIG. 10 a cross-sectional view of the pressure source 236 is illustrated, showing a fill valve 308 and a passage 306 extending from the fill valve to the chamber 304 for supplying pressurized fluid to the chamber.

The device 238 for increasing pressure in the pressure source 236 includes an annular floating piston 310 which separates the chamber 304 from another chamber 312. The chamber 312 is in communication with the exterior of the sampler 230 via openings 314. Alternatively, the chamber 312 could be in communication with the passage 242. In addition, a check valve (such as the check valves 142, 204, 206) could be used to prevent pressure received in the chamber 312 from escaping back to the annulus 26 and/or passage 242, if desired.

Hydrostatic pressure at the sampler 230 in the well is thus applied using the device 238 to increase the pressure in the pressure source 236. As discussed above, the hydrostatic pressure may be applied from the annulus 26 and/or from the passage 242 in the assembly. Pressure greater than hydrostatic may also be applied from the annulus 26 and/or from the passage 242 in the assembly.

The actuator 234 (see FIG. 8A) includes multiple valves 316, 318, 320 and respective multiple rupture disks 322, 324, 326 (see FIG. 9) to provide for separate actuation of multiple groups of the sampling sections 228. In the illustrated embodiment, nine sampling sections 228 may be used, and these are divided up into three groups of three sampling sections each.

Thus, a valve 316, 318 or 320 and a respective rupture disk 322, 324 or 326 are used to actuate a group of three sampling sections 228. For clarity, operation of the actuator 234 with respect to only one of the valves 316, 318, 320 and its respective one of the rupture disks 322, 324, 326 is described first below. Operation of the actuator 234 with respect to the other valves and rupture disks is similar to that described below.

The valve 316 initially isolates the passage 294 (which is in communication with the passages 240 in three of the sampling sections 228 via another passage 328) from the passage 242 in the assembly. This isolates the sample chamber 244 in each of the three sampling sections 228 from the passage 242.

Figure 9:
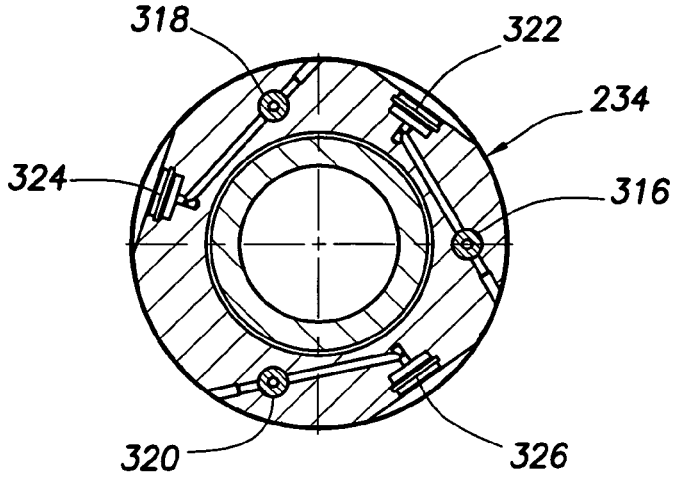
FIG. 9 is a cross-sectional view of the actuator section, taken along line 9—9 of FIG. 8A.

When it is desired to receive a fluid sample into each of the sample chambers 244 of the three sampling sections 228, pressure in the annulus 26 is increased a sufficient amount to rupture the disk 322 (see FIG. 9). This permits pressure in the annulus 26 to shift the valve 316 upward, thereby opening the valve and permitting communication between the passage 242 and the passages 294, 328.

Fluid from the passage 242 enters the passage 240 in the upper portion of each of the three sampling sections 228. For clarity, the operation of only one of the sampling sections 228 after receipt of a fluid sample therein is described below.

The fluid flows from the passage 240 through the check valve 246 to the sample chamber 244. An initial volume of the fluid is trapped in the debris chamber 256 of the piston 248 as described above.

Downward displacement of the piston section 254, and then the combined piston sections 252, 254, is slowed by the metering fluid in the chamber 250 flowing through the restrictor 264. This prevents pressure in the fluid sample received in the sample chamber 244 from dropping below its bubble point.

Thus, as the piston 248 displaces downward, the metering fluid in the chamber 250 flows through the restrictor 264 into the chamber 268. At this point, the prong 272 maintains the check valve 274 off seat.

The metering fluid received in the chamber 268 causes the piston 276 to displace downward. Eventually, the spacer 280 contacts the stem 282 of the valve 284 and the valve is opened.

Opening of the valve 284 permits pressure in the pressure source 236 to be applied to the chamber 278 and thence to the chambers 268, 250 and the sample chamber 244. This is due to the fact that the passage 286 is in communication with the passages 296, 302 (see FIG. 8C) and, thus, is in communication with the pressurized fluid in the pressure source 236.

When the pressure from the pressure source 236 is applied to the chamber 268, the piston assembly 270 collapses and the prong 272 no longer maintains the check valve 274 off seat. The check valve 274 then prevents pressure from escaping from the chamber 250 and (via the piston 248) the sample chamber 244. The check valve 246 also prevents escape of pressure from the sample chamber 244.

In this manner, the fluid sample received in the sample chamber 244 is pressurized to at least hydrostatic pressure at the sampler 230 in the well. The fluid sample in the sample chamber 244 can be further pressurized using any of the techniques described above for the samplers 30, 100, 160. For example, pressure in the annulus 26 can be increased by applying pump pressure at the surface, hydrostatic pressure at the sampler 230 can be increased by circulating a higher density fluid into the well, the chamber 312 of the device 238 could be in communication with the passage 242 instead of the annulus 26, in which case pressure in the passage 16 of the tubular string could be increased to thereby increase pressure in the pressure source 236, a pump could be operated in the sampler 230 to increase pressure, a pyrotechnic device, propellant, etc. could be used to increase pressure, etc. Any method, any type of method, and any combination of methods may be used to increase pressure in the pressure source 236 and in the sample chamber 244 to greater than hydrostatic pressure, or to increase hydrostatic pressure at the sampler 230.

In the illustrated embodiment of the sampler 230, multiple (three) sampling sections 228 are actuated by rupturing the disk 322, since the valve 316 is used to provide selective communication between the passage 242 and the passages 240 in the upper portions of multiple sampling sections. Thus, multiple sampling sections 228 simultaneously receive fluid samples therein from the passage 242.

In a similar manner, when the rupture disk 324 is ruptured, an additional group of multiple sampling sections 228 will receive fluid samples therein, and when the rupture disk 326 is ruptured a further group of multiple sampling sections will receive fluid samples therein. The rupture disks 322, 324, 326 may be selected so that they are ruptured sequentially (i.e., at different pressures in the annulus 26), or they may be selected so that they are ruptured simultaneously (i.e., at the same pressure in the annulus 26).

Another important feature of the sampler 230 is that the multiple sampling sections 228 (nine of them in the illustrated embodiment) share the same pressure source 236. That is, the pressure source 236 is in communication with each of the multiple sampling sections.

This feature provides enhanced convenience, speed, economy and safety in the fluid sampling operation. For example, multiple gas chambers do not have to be pressurized at the surface prior to installing the sampler 230, multiple gas chambers do not have to be handled or maintained at the surface, and since the chamber 304 is annular shaped and circumscribes the passage 242, the assembly can be shorter and less expensive to manufacture, etc.

Note that, although the actuator 234 is described above as being configured to permit separate actuation of three groups of sampling sections 228, with each group including three of the sampling sections, it will be appreciated that any number of sampling sections may be used, the sampling sections may be included in any number of groups (including one), each group could include any number of sampling sections (including one), different groups can include different numbers of sampling sections, and it is not necessary for the sampling sections to be separately grouped at all.

Figure 11:
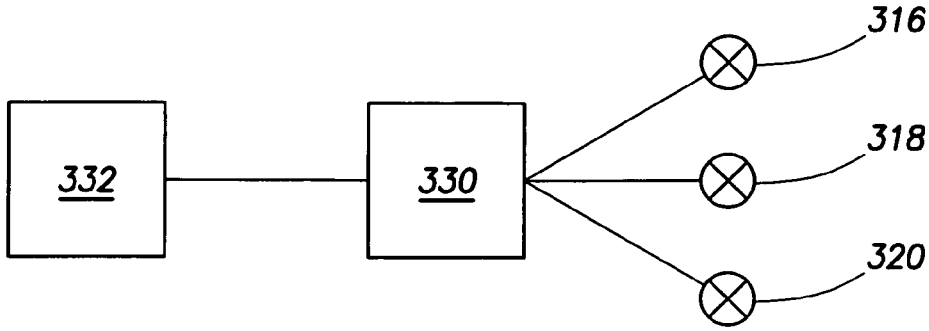
FIG. 11 is a schematic view of an alternate actuating method for the fourth fluid sampler.

Referring additionally now to FIG. 11, an alternate actuating method for the sampler 230 is representatively and schematically illustrated. Instead of using increased pressure in the annulus 26 to actuate the valves 316, 318, 320, the valves are actuated by a control module 330 included in the sampler 230.

A telemetry receiver 332 is connected to the control module 330. The receiver 332 may be any type of telemetry receiver, such as a receiver capable of receiving acoustic signals, pressure pulse signals, electromagnetic signals, mechanical signals, etc. Any type of telemetry may be used to transmit signals to the receiver 332.

When the control module 330 determines that an appropriate signal has been received by the receiver 332, the control module causes a selected one or more of the valves 316, 318, 320 to open, thereby causing one or more fluid samples to be taken in the sampler 230. The valves 316, 318, 320 may be configured to open in response to application or release of electrical current, fluid pressure, biasing force, temperature, etc.

The actuation method of FIG. 11 may be used for any of the other samplers 30, 100, 160 described above, as well. For example, instead of the valves 316, 318, 320, the control module 330 and receiver 332 could be used to actuate a valve in place of the rupture disk 80 in the sampler 30, to actuate a valve in place of the rupture disk 146 in the sampler 100, or to actuate the valve 178 in the sampler 160.

The actuation method depicted in FIG. 11 also demonstrates that the invention is not limited to actuation by increasing pressure in the annulus 26 to rupture a disk. Instead, any actuation method may be used in keeping with the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. For example, where a certain type of valve or other flow control device is described, those skilled in the art will appreciate that other types of valves and other flow control devices can be substituted. Accordingly, the foregoing detailed description is to be clearly understood as being given by way of illustration and example only, the spirit and scope of the present invention being limited solely by the appended claims and their equivalents.

What is claimed is:

1. A fluid sampling method for taking at least one fluid sample in a subterranean well, the method comprising the steps of:

receiving the fluid sample into at least a first sample chamber of a fluid sampler;

pressurizing the fluid sample in the first sample chamber using a pressure source of the fluid sampler; and increasing pressure in the pressure source while the pressure source is in the well, thereby applying increased pressure to the fluid sample in the first sample chamber, and the pressure increasing step including increasing pressure in the pressure source after receiving the fluid sample in the first sample chamber, and by applying greater than hydrostatic pressure to the well and a device operative to increase pressure in the pressure source in response to application of pressure to at least one of a tubular string in the well and an annulus formed between the tubular string and a wellbore of the well.

2. The method of claim 1, wherein the fluid sampler includes an interior flow passage formed longitudinally through the fluid sampler, and wherein the increasing pressure step further comprises applying hydrostatic pressure in the flow passage to the pressure source.

3. The method of claim 2, wherein the increasing pressure step further comprises increasing pressure in the flow passage, thereby applying greater than hydrostatic pressure to the pressure source.

4. The method of claim 1, wherein the increasing pressure step further comprises pressurizing the fluid sample to a pressure greater than a bubble point of the fluid sample.

5. The method of claim 1, wherein the fluid sampler includes an interior flow passage formed longitudinally through the fluid sampler, and wherein the first sample chamber circumscribes the flow passage.

6. The method of claim 1, further comprising the step of connecting the pressure source to a second sample chamber.

7. The method of claim 6, wherein the receiving step further comprises receiving fluid into the second sample chamber simultaneously with receiving the fluid sample into the first sample chamber.

8. The method of claim 6, wherein the receiving step further comprises receiving fluid into the second sample chamber after receiving the fluid sample into the first sample chamber.

9. A fluid sampling method for taking at least one fluid sample in a subterranean well, the method comprising the steps of:

receiving the fluid sample into at least a first sample chamber of a fluid sampler;

pressurizing the fluid sample in the first sample chamber using a pressure source of the fluid sampler; and increasing pressure in the pressure source while the pressure source is in the well, thereby applying increased pressure to the fluid sample in the first sample chamber, and the pressure increasing step including increasing pressure in the pressure source after receiving the fluid sample in the first sample chamber, and by applying greater than hydrostatic pressure to the well, an annulus being formed between the fluid sampler and a wellbore of the well, and wherein the increasing pressure step further comprises applying hydrostatic pressure in the annulus to the pressure source.

10. A fluid sampling method for taking at least one fluid sample in a subterranean well, the method comprising the steps of:

receiving the fluid sample into at least a first sample chamber of a fluid sampler;

pressurizing the fluid sample in the first sample chamber using a pressure source of the fluid sampler; and increasing pressure in the pressure source while the pressure source is in the well, thereby applying increased pressure to the fluid sample in the first sample chamber, and the increasing pressure step further including increasing pressure in an annulus formed between the fluid sampler and a wellbore of the well, thereby applying hydrostatic pressure in the annulus to the pressure source and applying greater than hydrostatic pressure to the pressure source.

11. A fluid sampling method for taking at least one fluid sample in a subterranean well, the method comprising the steps of:

receiving the fluid sample into at least a first sample chamber of a fluid sampler, the fluid sampler including an interior flow passage formed longitudinally through the fluid sampler, the first sample chamber circumscribing the flow passage, a generally tubular mandrel being positioned between the first sample chamber and the flow passage, and wherein the receiving step further comprises exposing the first sample chamber to the flow passage, and then displacing the mandrel to isolate the first sample chamber from the flow passage;

pressurizing the fluid sample in the first sample chamber using a pressure source of the fluid sampler; and increasing pressure in the pressure source while the pressure source is in the well, thereby applying increased pressure to the fluid sample in the first sample chamber.

12. A fluid sampler system for use in taking at least one fluid sample in a subterranean well, the system comprising:

a fluid sampler including at least a first sample chamber, a pressure source for pressurizing the first sample chamber, and a device which operates to increase pressure in the pressure source while the fluid sampler is in the well, wherein the fluid sampler further includes a flow passage formed longitudinally through the fluid sampler, wherein the first sample chamber circumscribes the flow passage, wherein the fluid sampler further includes a generally tubular mandrel positioned between the first sample chamber and the flow passage, and wherein the mandrel is displaceable to selectively expose the first sample chamber to the flow passage and isolate the first sample chamber from the flow passage.

13. The system of claim 12, further comprising a second sample chamber, and wherein the pressure source is further operative to pressurize the second sample chamber.

14. The system of claim 13, further comprising an actuator which simultaneously admits fluid into the first and second sample chambers.

15. The system of claim 13, further comprising an actuator which sequentially admits fluid into the first and second sample chambers.

16. The system of claim 12, wherein the device admits pressure from an exterior of the fluid sampler to the pressure source.

17. The system of claim 12, wherein the fluid sampler further includes a flow passage formed longitudinally through the fluid sampler, and wherein the device admits pressure from the flow passage to the pressure source.

18. The system of claim 12, wherein the pressure source includes a compressed fluid.

19. The system of claim 18, wherein the fluid includes a gas.

20. The system of claim 18, wherein the fluid includes a liquid.

21. A method of taking at least one fluid sample in a subterranean well, the method comprising the steps of:

positioning a fluid sampler in the well;

receiving the fluid sample into at least a first sample chamber of the fluid sampler;

then pressurizing the fluid sample using a pressure source of the fluid sampler; and then applying pressure into the well to thereby increase pressure in the pressure source, and to thereby increase pressure on the fluid sample.

22. The method of claim 21, wherein the positioning step further comprises interconnecting the fluid sampler in a tubular string.

23. The method of claim 21, wherein the applying pressure step further comprises applying pressure to at least one of a tubular string in the well and an annulus formed between the tubular string and a wellbore of the well.

24. The method of claim 21, wherein the applying pressure step further comprises increasing a weight of fluid in the well.

25. The method of claim 21, wherein the applying pressure step further comprises increasing pressure on the fluid sample to at least hydrostatic pressure in the well at the fluid sampler.

26. The method of claim 21, wherein the applying pressure step further comprises increasing pressure on the fluid sample to greater than hydrostatic pressure in the well at the fluid sampler.

27. The method of claim 21, wherein the applying pressure step further comprises increasing pressure in the pressure source to at least hydrostatic pressure in the well at the fluid sampler.

28. The method of claim 21, wherein the applying pressure step further comprises increasing pressure in the pressure source to greater than hydrostatic pressure in the well at the fluid sampler.

29. The method of claim 21, wherein the pressure source includes a compressed fluid, and wherein the applying pressure step comprises further compressing the compressed fluid.

30. The method of claim 21, wherein the positioning step further comprises positioning a second sample chamber in the well, and further comprising the step of connecting the second sample chamber to the pressure source.

31. A fluid sampler system for use in taking at least one fluid sample in a subterranean well, the system comprising:

a fluid sampler including:

at least a first sample chamber, a pressure source having a compressed gas chamber for pressurizing the first sample chamber after the fluid sample is received in the first sample chamber, and a device which operates to increase pressure in the compressed gas chamber while the fluid sampler is in the well, the device further being operative to increase pressure in the compressed gas chamber to greater than hydrostatic pressure in the well at the fluid sampler, and the device being operative to increase pressure in the compressed gas chamber in response to application of pressure to at least one of a tubular string in the well and an annulus formed between the tubular string and a wellbore of the well.

32. The system of claim 31, wherein the compressed gas chamber further pressurizes a second sample chamber.

33. The system of claim 31, wherein the device increases pressure in the compressed gas chamber in response to increased hydrostatic pressure in the well.

34. The system of claim 31, wherein the device increases pressure in the compressed gas chamber after the fluid sample is received in the first sample chamber.

* * * * *